US009122241B2

(12) United States Patent
Itabashi et al.

(10) Patent No.: US 9,122,241 B2
(45) Date of Patent: Sep. 1, 2015

(54) PROCESS CARTRIDGE CAPABLE OF ACCURATELY POSITIONING DEVELOPER CARRYING MEMBER AND PHOTOSENSITIVE DRUM

(75) Inventors: Nao Itabashi, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 204 days.

(21) Appl. No.: 13/599,331

(22) Filed: Aug. 30, 2012

(65) Prior Publication Data

US 2013/0051848 A1 Feb. 28, 2013

(30) Foreign Application Priority Data

Aug. 31, 2011 (JP) ..... 2011-190039

(51) Int. Cl.
*G03G 21/18* (2006.01)

(52) U.S. Cl.
CPC ..... *G03G 21/1857* (2013.01); *G03G 21/1821* (2013.01); *G03G 21/1864* (2013.01); *G03G 2221/1869* (2013.01)

(58) Field of Classification Search
CPC ..... G03G 21/1803; G03G 21/181; G03G 21/1821; G03G 21/1864; G03G 2221/183; G03G 2221/1869; G03G 21/1857
USPC ..... 399/111–114, 116, 117, 167, 262, 263
See application file for complete search history.

(56) References Cited

U.S. PATENT DOCUMENTS 5,983,055 A 11/1999 Bito et al.
6,016,413 A * 1/2000 Yokoyama et al. ..... 399/113
6,021,291 A * 2/2000 Karakama et al. ..... 399/104
6,185,393 B1 * 2/2001 Karakama et al. ..... 399/103
6,400,914 B1 * 6/2002 Noda et al. ..... 399/90
6,885,838 B2 * 4/2005 Kawai et al. ..... 399/167

(Continued)

FOREIGN PATENT DOCUMENTS

JP H06-35245 A 2/1994
JP H09-258606 A 10/1997

(Continued)

OTHER PUBLICATIONS

Jun. 30, 2015—(JP) Office Action—App 2011-190039.

*Primary Examiner* — David Gray
*Assistant Examiner* — Carla Therrien
(74) *Attorney, Agent, or Firm* — Banner & Witcoff, Ltd.

(57) ABSTRACT

A process cartridge includes a developing cartridge, drum cartridge, and end member. The developing cartridge and drum cartridge include first and second driving force receiving units, respectively. The second receiving unit is disposed on the same side on which the first receiving unit in an axis direction of photosensitive drum. A developing frame is movable within a prescribed distance in the axis direction relative to a photosensitive drum frame. The photosensitive drum is movable in the axis direction relative to the drum frame within a predetermined distance. The end member includes a drum contact surface, developing frame contact surface, and external member contact surface. When the first and second receiving units are in a predetermined state, a photosensitive drum contacts to the drum contact surface, the developing frame contacts to the developing frame contact surface, the external member contact surface contacts to an external member.

14 Claims, 12 Drawing Sheets

(56) References Cited

U.S. PATENT DOCUMENTS

| | | | | |
|---|---|---|---|---|
| 6,941,092 | B2 * | 9/2005 | Yokoi | 399/109 |
| 6,999,696 | B2 * | 2/2006 | Noda et al. | 399/90 |
| 7,092,655 | B2 * | 8/2006 | Noda et al. | 399/90 |
| 7,509,071 | B2 * | 3/2009 | Yoshimura et al. | 399/111 |
| 7,613,414 | B2 | 11/2009 | Kamimura | |
| 7,813,671 | B2 * | 10/2010 | Nittani et al. | 399/113 |
| 8,135,300 | B2 * | 3/2012 | Kamimura et al. | 399/90 |
| 8,180,252 | B2 * | 5/2012 | Itabashi | 399/117 |
| 8,238,784 | B2 * | 8/2012 | Kusudo et al. | 399/109 |
| 8,472,840 | B2 * | 6/2013 | Abe et al. | 399/111 |
| 8,583,001 | B2 * | 11/2013 | Kubo et al. | 399/103 |
| 8,688,003 | B2 * | 4/2014 | Maeshima et al. | 399/111 |
| 8,725,042 | B2 * | 5/2014 | Watanabe et al. | 399/167 |
| 2002/0018666 | A1 * | 2/2002 | Noda et al. | 399/90 |
| 2007/0140725 | A1 | 6/2007 | Kamimura | |
| 2009/0169256 | A1 | 7/2009 | Kamimura et al. | |
| 2009/0317129 | A1 * | 12/2009 | Abe et al. | 399/111 |
| 2010/0021206 | A1 * | 1/2010 | Itabashi | 399/159 |

FOREIGN PATENT DOCUMENTS

| | | | |
|---|---|---|---|
| JP | H10-232526 | A | 9/1998 |
| JP | 2002-214869 | A | 7/2002 |
| JP | 2005-284179 | A | 10/2005 |
| JP | 2007-093753 | A | 4/2007 |
| JP | 2009162908 | A | 7/2009 |

* cited by examiner

REAR
FRONT
LEFT
RIGHT
L1
L2

PROCESS CARTRIDGE CAPABLE OF ACCURATELY POSITIONING DEVELOPER CARRYING MEMBER AND PHOTOSENSITIVE DRUM

CROSS REFERENCE TO RELATED APPLICATION

This application claims priority from Japanese Patent Application No. 2011-190039 filed Aug. 31, 2011. The entire content of the priority application is incorporated herein by reference.

TECHNICAL FIELD

The present invention relates to a process cartridge for being mounted in an image forming apparatus of an electrophotographic type.

BACKGROUND

There has been conventionally known a printer of an electrophotographic type, in which a process cartridge is detachably mountable. The process cartridge includes a drum cartridge and a developing cartridge detachably mounted on the drum cartridge. The drum cartridge includes a drum frame and a photosensitive drum rotatably supported by the drum frame. The developing cartridge includes a developing frame and a developing roller rotatably supported by the developing frame.

SUMMARY

In the conventionally-known printer, the developing roller and the photosensitive drum may be aligned with one side wall of the drum frame and another side of the drum frame, respectively. Accordingly, this printer cannot provide sufficient accuracy of positioning the developing roller and the photosensitive drum relative to each other.

In view of the foregoing, it is an object of the invention to provide a process cartridge capable of more accurately positioning a developer carrying member and a photosensitive drum relative to each other.

In order to attain the above and other objects, the invention provides a process cartridge including a developing cartridge, a drum cartridge, and an end member. The developing cartridge includes a developer carrying member, a developing frame, and a first receiving unit. The developer carrying member defines an axis extending in a first axis direction and is configured to rotate around the axis. The developing frame is configured to accommodate the developer carrying member therein and has a first side portion and a second side portion that is opposite to the first side portion in the first axis direction. The first receiving unit is disposed on the first side portion and is capable of receiving a first driving force for rotating the developer carrying member when the first receiving unit is in a predetermined state. The drum cartridge includes a drum frame, a photosensitive drum, and a second receiving unit. The developing frame is mounted to the drum frame such that the developing frame is movable within a prescribed range of distance in the first axis direction relative to the drum frame. The photosensitive drum extends in a second axis direction parallel to the first axis direction and is configured to rotate relative to the drum frame. The photosensitive drum is movable in the second axis direction relative to the drum frame within a predetermined range of distance. The photosensitive drum has a first end portion and a second end portion opposite to the first end portion in the second axis direction. The first end portion is closer to the first side portion than to the second side portion. The second end portion is closer to the second side portion than to the first side portion. The second receiving unit is disposed on the first end portion and is capable of receiving a second driving force for rotating the photosensitive drum when the second receiving unit is in a predetermined state. The end member includes a drum contact surface, a developing frame contact surface, and an external member contact surface. When both the first receiving unit and the second receiving unit are in the predetermined state, the second end portion of the photosensitive drum contacts to the drum contact surface, the second side portion of the developing frame contacts to the developing frame contact surface, the external member contact surface is configured to contact with an external member. The external member contact surface is disposed farther from the second end portion of the photosensitive drum in the second axis direction than the developing frame contact surface is.

According to another aspect, the present invention provides a process cartridge including a developing unit and photosensitive unit. The developing unit includes a developer carrying member, a developing gear, and a first transmitting unit. The developer carrying member defines an axis extending in a first axis direction and is configured to rotate around the axis. The developing carrying member has a first side portion and a second side portion that is opposite to the first side portion in the first axis direction. The developing gear is disposed on the first side portion of the developer carrying member. The first transmitting unit is configured to transmit a first driving force to the developer carrying member via the developing gear. The photosensitive unit includes a photosensitive drum, a drum gear, and a second transmitting unit. The photosensitive drum extends in a second axis direction parallel to the first axis direction. The photosensitive drum has a first end portion and a second end portion opposite to the first end portion in the second axis direction. The first end portion is closer to the first side portion than to the second side portion. The second end portion is closer to the second side portion than to the first side portion. The drum gear is disposed on the first end portion of the photosensitive drum. The second transmitting unit is configured to transmit a second driving force to the photosensitive drum. The drum gear and developing gear are partially overlapped when being projected in a direction parallel to the first axis direction.

According to another aspect, the present invention provides a photosensitive unit includes an element tube and a flange member. The element tube extends in an axis direction and has a first end part in the axis direction, the first end part having a first end. The flange member is fitted on the first end part and has a receiving unit configured to receive a driving force, and an edge portion confronting to the first end. The edge portion includes a facing portion and a plurality of projecting portions. The facing portion is configured to face to and is spaced apart from the first end. The plurality of projecting portions projects from the facing portion toward the element tube in the second axis direction and is configured to contact with the first end.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Configuration of Printer

Figure 1:
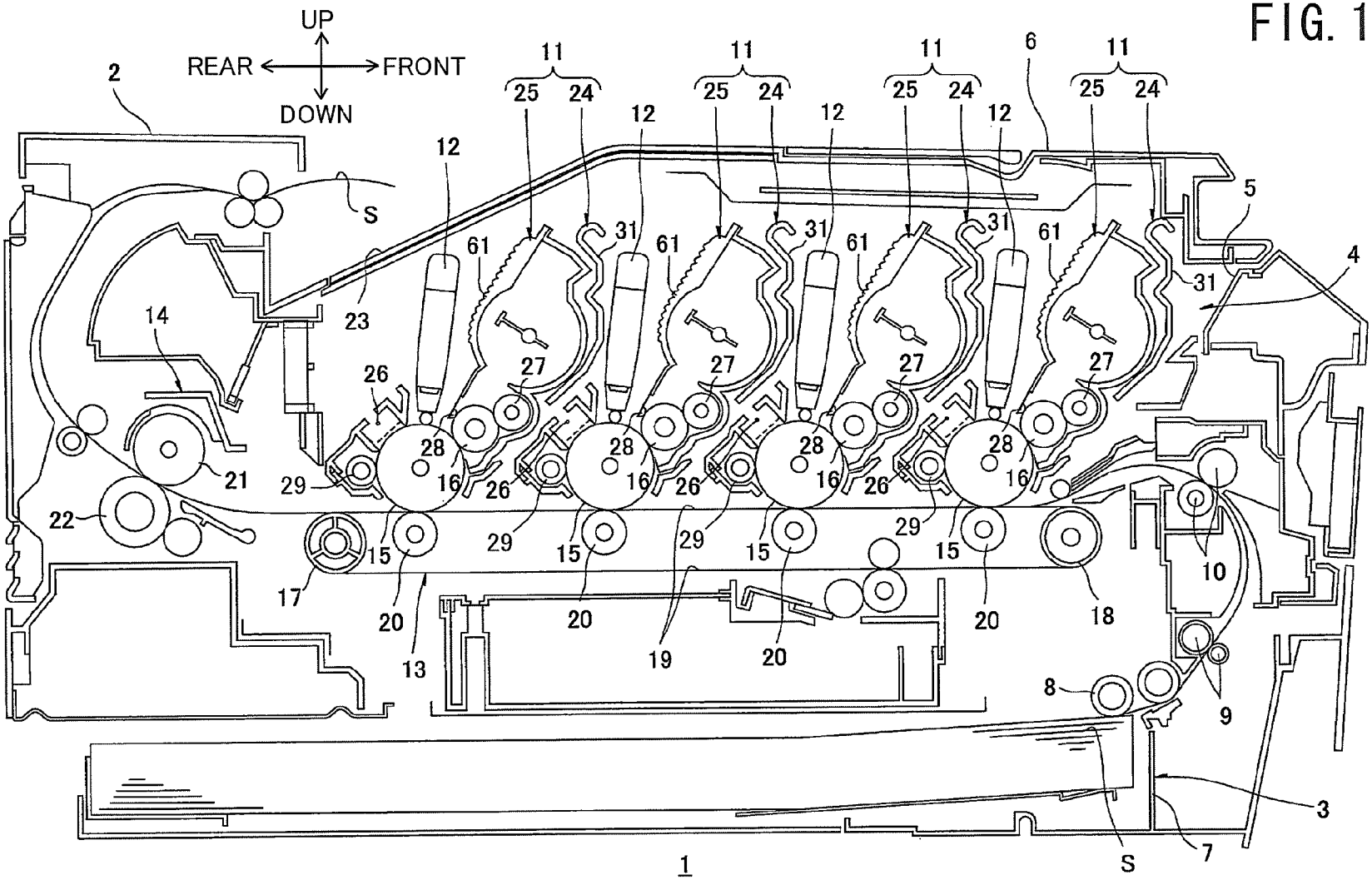
FIG. 1 is a side sectional view of a printer, in which process cartridges according to an embodiment of the present invention are detachably mounted.

As shown in FIG. 1, a printer 1 is a color printer that is of a horizontal type as well as of a direct tandem type.

In the following description, at the time of referring to directions, the right side on paper surface of FIG. 1 is referred to as front side, and the left side on paper surface of FIG. 1 as rear side with respect to the situation where the printer 1 and process cartridges 11 are placed horizontally. The criteria of left and right are set when the front side of the printer 1 is seen. That is, the near side on paper surface of FIG. 1 is referred to as left side, and the back side on paper surface as right side.

The printer 1 includes a main casing 2, a paper feeding portion 3 used to feed paper S, and an image formation portion 4 used to form an image on the fed paper S. The paper feeding portion 3 and the image formation portion 4 is disposed in the main casing 2.

(1) Main Casing

The main casing 2 is formed in the box shape that is substantially in the shape of a rectangle when being viewed from the side to house the paper feeding portion 3 and the image formation portion 4. A main-casing opening 5 is formed in a top end of the main casing 2 and allows each of the process cartridges 11 (described later) to be attached thereto and removed therefrom. A top cover 6 is swingably provided on the top end of the main casing 2 with a rear end portion thereof as a fulcrum. The top cover 6 is configured to open and close the main-casing opening 5.

(2) Paper Feeding Portion

The paper feeding portion 3 is mounted on a bottom portion of the main casing 2 in such a way that the paper feeding portion 3 can be freely attached thereto and removed therefrom. The paper feeding portion 3 includes: a paper feed tray 7 in which sheets of paper S are stacked; a pickup roller 8 and a pair of paper feeding rollers 9 that are provided above a front end portion of the paper feed tray 7; and a pair of resist rollers 10 that is provided above the pair of paper feeding rollers 9.

When the pickup roller 8 and the two paper feeding rollers 9 rotate, sheets of paper S stored in the paper feed tray 7 are fed one after another to between the pair of resist rollers 10 and are transferred to the image formation portion 4 (between a photosensitive drum 15 (described later) and a conveyance belt 19 (described later)) at predetermined timing.

(3) Image Formation Portion

The image formation portion 4 includes a plurality of (four) process cartridges 11 corresponding to each color, a plurality (four) of LED units 12, a transfer unit 13, and a fixing unit 14.

(3-1) Process Cartridge

Above the paper feeding portion 3, the process cartridges 11 are each mountable in and detachable from the main casing 2, and are spaced away from each other in the front-rear direction and are arranged in parallel to each other. Each process cartridge 11 includes a drum cartridge 24 and a developing cartridge 25. The developing cartridge 25 is detachably mountable on the drum cartridge 24.

The drum cartridge 24 includes a photosensitive drum 15, a Scorotron-type charger 26, a developing roller 16, a supply roller 27, and a layer thickness regulating blade 28.

The photosensitive drum 15 is formed in the cylindrical shape extending in the left-right direction and is rotatably provided in the drum cartridge 24.

The Scorotron-type charger 26 is disposed on the rear side of the photosensitive drum 15 so as to be spaced out therefrom and to face the photosensitive drum 15.

The developing roller 16 is mounted in a rear end portion of developing cartridge 25 such that a rear side part of the developing roller 16 is exposed to the outside of the developing cartridge 25 and is in contact with a front upper side part of the photosensitive drum 15.

The supply roller 27 is configured to supply toner to the developing roller 16. The layer thickness regulating blade 28 is configured to regulate the thickness of the toner supplied to the developing roller 16. The developing cartridge 25 accommodates toner in a space thereof above the supply roller 27 and the layer thickness regulating blade 28.

(3-2) LED Unit

Each LED unit 12 is provided above and in rear of corresponding process cartridge 11 so as to face an upper side portion of the corresponding photosensitive drum 15. Each LED unit 12 is configured to expose a surface of the corresponding photosensitive drum 15 on the basis of predetermined image data.

(3-3) Transfer Unit

The transfer unit 13 is disposed above the paper feeding portion 3 and below each process cartridge 11 along the front-rear direction. The transfer unit 13 is provided with a driving roller 17, a following roller 18, the conveyance belt 19, and four transfer rollers 20.

The driving roller 17 and the following roller 18 are spaced away from each other in the front-rear direction and face each other. The conveyance belt 19 is wound around the driving roller 17 and the following roller 18 such that the conveyance belt 19 faces a lower side portion of each photosensitive drum 15 and that an upper side portion of the conveyance belt 19 is in contact with each photosensitive drum 15. The conveyance belt 19 circumferentially moves in such a way that the upper side portion that is in contact with each photosensitive drum 15 moves from the front to the rear side as the conveyance belt 19 is driven by the driving roller 17. The transfer rollers 20 face respective photosensitive drums 15 via the upper side portion of the conveyance belt 19.

(3-4) Fixing Unit

The fixing unit 14 is disposed on the rear side of the transfer unit 13, and includes a heating roller 21 and a pressure roller 22. The pressure roller 22 is pressed against the heating roller 21.

(4) Image Formation Operation

The toner in each developing cartridge 25 is supplied to the corresponding supply roller 27, and then to the corresponding developing roller 16. The toner is triboelectrically charged to positive polarity between the supply roller 27 and the developing roller 16.

The thickness of the toner supplied to the developing roller 16 is controlled by the layer thickness regulating blade 28 as the developing roller 16 rotates. As a result, the toner is borne on the surface of the developing roller 16 as a thin layer of a constant thickness.

The surface of each photosensitive drum 15 is uniformly charged by the Scorotron-type charger 26 and is then exposed to light that is irradiated by the LED unit 12. As a result, an electrostatic latent image is formed on the surface of each photosensitive drum 15 on the basis of image data. Then, the toner carried on the developing roller 16 is supplied to the electrostatic latent image on the surface of each photosensitive drum 15. As a result, a toner image (developer image) is borne on the surface of the photosensitive drum 15.

A sheet of paper S is fed from the paper feeding portion 3 and is transferred from the front to the rear side by the conveyance belt 19. The toner image of each color is sequentially transferred onto the paper sheet S as the paper sheet S passes between each photosensitive drum 15 and each transfer roller 20 (Transfer Position), and a color image is formed on the sheet of paper S as a result.

The transfer unit 13 thermally fixes the transferred color image onto the paper sheet S by exposing the paper sheet S to heat and pressure while passing between the heating roller 21 and the pressure roller 22. Then, the paper sheet S is conveyed through a U-turn path to the front upper side of the main casing 2 and is finally discharged onto a paper discharge tray 23 provided on the top cover 6.

2. Process Cartridge (1) Drum Cartridge (1-1) Drum Frame

Figure 3:
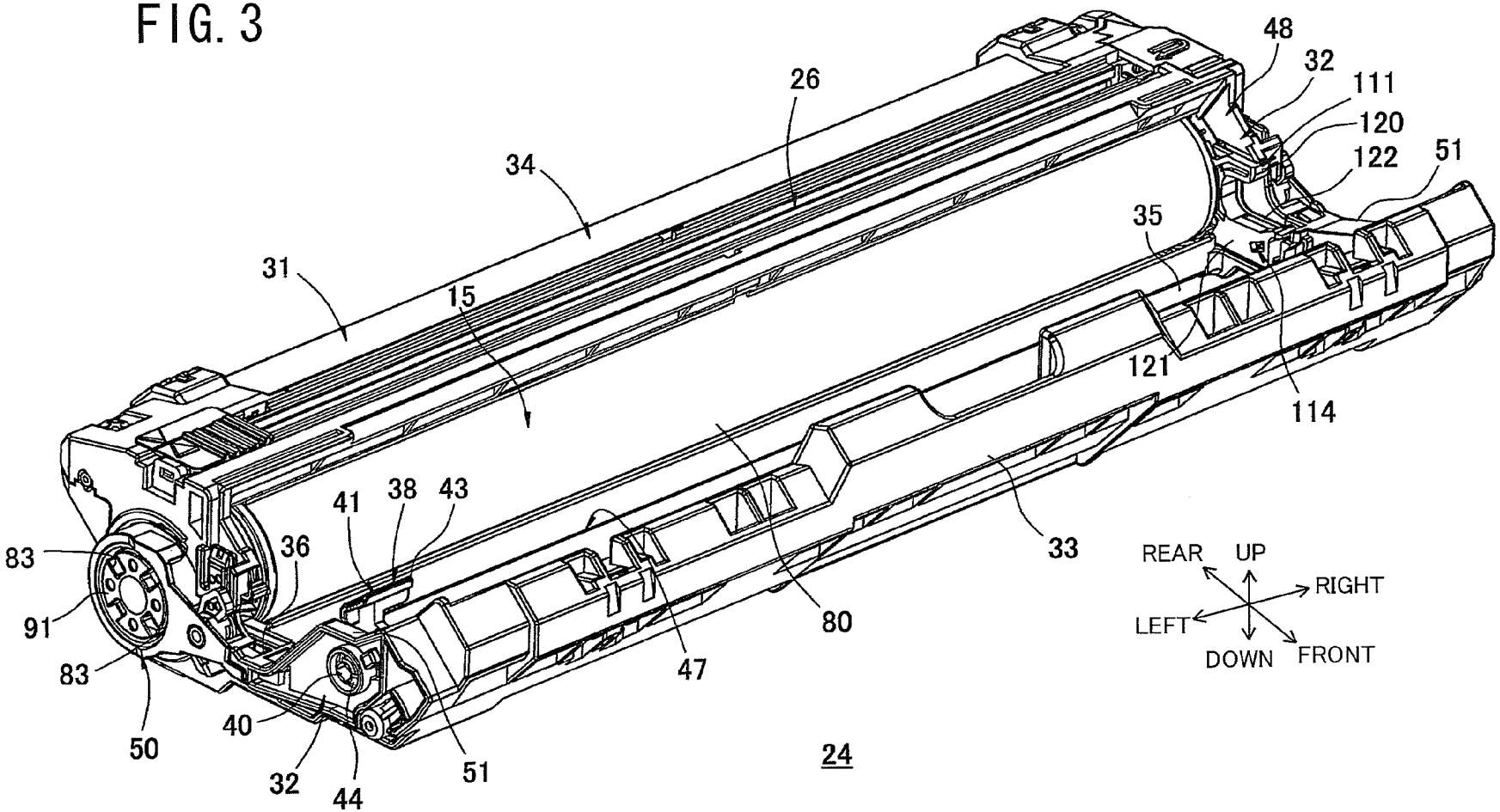
FIG. 3 is a perspective view from an upper left side of the drum cartridge shown in FIG. 2.

As shown in FIG. 3, the drum cartridge 24 is provided with a drum frame 31. The drum frame 31 is formed substantially in the rectangular shape that has a bottom. The drum frame 31 includes a pair of left and right side walls 32, a front wall 33, an upper wall 34, and a lower wall 35. The front wall 33 is disposed between front end portions of the two side walls 32, the lower wall 35 is disposed between lower end portions of the two side walls 32, and the upper wall 34 is disposed above an area between the rear end portions of the two side walls 32.

The side wall 32 is substantially formed in the rectangular shape when being viewed from the side so as to extend in the front-rear direction (more specifically, in the direction from the front upper side to the rear lower side).

Each side wall 32 is formed with a flange portion 51 and a drum bearing portion 50. The flange portion 51 is formed at a front side portion of side wall 32 corresponding to a developing cartridge mounting portion 47 (described later). The drum bearing portion 50 is formed at a rear side portion of the side wall 32 corresponding to a drum housing portion 48 (described later).

The flange portions 51 are formed substantially in the shape of a flat plate protruding from upper end portions of the front side portions of the two side walls 32 outwardly in the left-right direction.

A distance between outer side end portions of flange portions 51 in the left-right-direction is substantially equal to a left-right-direction maximum length (described later) of the developing cartridge 25 (See FIGS. 2 and 11).

The drum bearing portions 50 are formed in the substantial cylindrical shape so as to protrude from the left-right-direction outer side surfaces of the two side walls 32 outwardly in the left-right direction. The drum bearing portions 50 communicate with each other in the left-right direction. The drum bearing portions 50 are formed such that an inner diameter of the drum bearing portion 50 is substantially equal to or slightly larger than outer diameters of cylindrical portions 112 and 127 (described later, see FIG. 4A).

A development coupling exposure groove 36 and a locking lever support hole 44 are formed on the left side wall 32. The development coupling exposure groove 36 exposes a development coupling 62 (described later, FIG. 2).

The development coupling exposure groove 36 is substantially positioned at the center in the front-rear direction of the left side wall 32. The development coupling exposure groove 36 is substantially formed in a V-shape opening upward and cut downward from the upper-end edge when being viewed from the left side.

The locking lever support hole 44 is formed on a front side of the development coupling exposure groove 36 so as to pass through the left side wall 32 and substantially formed in the circle-shape when being viewed from the left side. The diameter of the locking lever support hole 44 is substantially equal to the diameter of a pivot shaft 40 (described later) of a locking lever 38 (described later).

The front wall 33 is formed substantially in the shape of a flat plate extending in the left-right direction. The lower wall 35 is formed substantially in a flat plate shape so as to extend in the front-rear direction and the left-right direction. The lower wall 35 connects seamlessly to a lower end portion of the front wall 33. The upper wall 34 is formed substantially in a flat plate shape so as to extend in the left-right direction and to cover the photosensitive drum 15 from the upper side. The Scorotron-type charger 26 is supported on the upper wall 34.

(1-2) Developing Cartridge Mounting Portion

In the drum frame 31, the developing cartridge mounting portion 47 is partitioned off by the front side portions of the two side walls 32, the corresponding front wall 33 and lower wall 35, and an upper end portion of the upper wall 34. The developing cartridge 25 is mounted in the developing cartridge mounting portion 47.

In the developing cartridge mounting portion 47, the locking lever 38 is provided on the front side of the development coupling exposure groove 36 and on the right side (or left-right-direction inside) of the left side wall 32. The locking lever 38 is used to lock the developing cartridge 25 mounted in the developing cartridge mounting portion 47.

The locking lever 38 is integrally provided with the pivot shaft 40 and an operation portion 41 extending from the pivot shaft 40 to the upper side. The pivot shaft 40 is formed substantially in the shape of a column so as to extend in the left-right direction. The operation portion 41 is formed substantially in a rod-shape extending from a right end portion of the pivot shaft 40 upwardly and having an upper end portion positioned above an upper-end edge of the left side wall 32. A guide portion 43 is provided in the upper end portion of the operation portion 41 (See FIGS. 3 and 11). The guide portion 43 is substantially in the shape of a flat plate and extends in the left-right direction. The right end portion of the guide portion 43 protrudes beyond a right end portion of the pivot shaft 40 rightward so as to enter a trajectory along which the developing cartridge 25 is attached to and removed from the drum cartridge 24.

The locking lever 38 is supported on the left side wall 32 so as to pivot between a locking position (FIG. 10C) and an unlocking position, by inserting a left end portion of the pivot shaft 40 into the locking lever support hole 44 of the left side wall 32. The operation portion 41 is raised at the locking position and is tilted at the unlocking position. The locking lever 38 is usually pushed in a counterclockwise direction when being viewed from the left side by a pushing member (not shown) such that the locking lever 38 is placed at the locking position.

(1-3) Drum Housing Portion

In the drum frame 31, a drum housing portion 48 is partitioned off by the rear side portions of the two side walls 32 and the upper wall 34. The drum housing portion 48 accommodates the photosensitive drum 15 and a drum cleaning roller 29 (see FIGS. 1 and 4A).

Figures 4A, 4B:
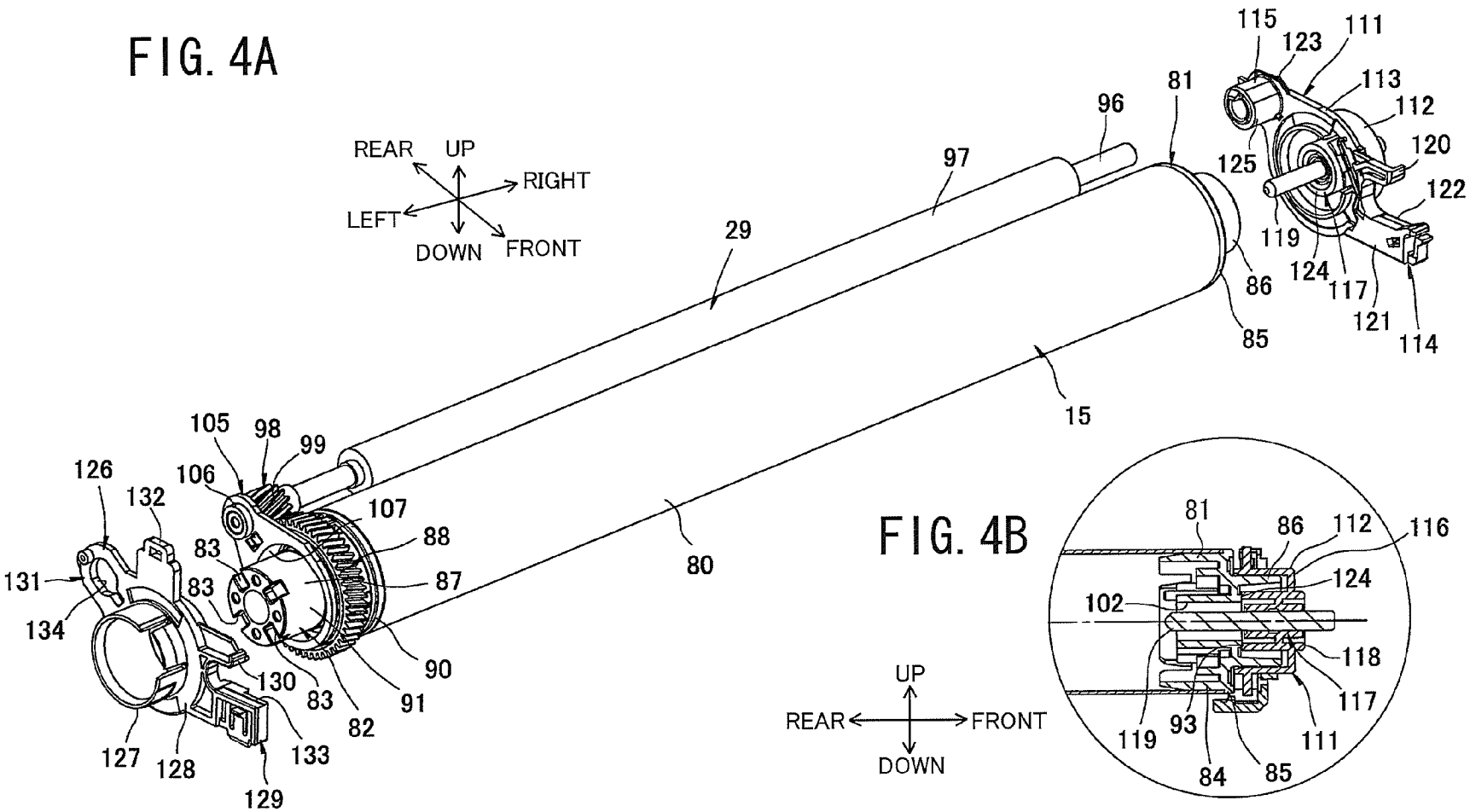
FIG. 4A is an exploded perspective view from an upper left side of a photosensitive drum and bearing member shown in FIG. 3.
FIG. 4B is an enlarged cross-sectional view of the photosensitive drum and the bearing member shown in FIG. 3 when the bearing member is fitted on the photosensitive drum.

As shown in FIG. 4A, the photosensitive drum 15 includes an element tube 80, a right flange member 81, and a left flange member 82. The right flange member 81 is provided in a right end portion of the element tube 80. The left flange member 82 is provided in a left end portion of the element tube 80.

The element tube 80 is made of metal and is formed substantially in a cylindrical shape so as to extend in the left-right direction. An outer circumferential surface of the element tube 80 is covered with a photoconductor layer.

The right flange member 81 is made of resin. As shown in FIG. 4B, the right flange member 81 is integrally provided with a right element tube fitting portion 84, an edge portion 85, and a right bearing fitting portion 86.

The right element tube fitting portion 84 is formed substantially in a cylindrical shape. A shaft insertion hole 102 is formed at a central portion of the right element tube fitting portion 84. The shaft insertion hole 102 is formed substantially in the shape of a circle when being viewed from the side so as to pass through the right element tube fitting portion 84 in the left-right direction.

The edge portion 85 is formed so as to project from an outer circumferential surface of a right end portion of the right element tube fitting portion 84 outwardly in a radial direction.

The right bearing fitting portion 86 is formed in a substantial cylindrical shape and has an outer diameter smaller than an outer diameter of the right element tube fitting portion 84. The right bearing fitting portion 86 is formed and disposed so as to share a central axis line with the right element tube fitting portion 84 (and the shaft insertion hole 102) and to project from the right element tube fitting portion 84 to the right side with a convex cross-sectional surface.

A peripheral edge of the shaft insertion hole 102 positioned on the right bearing fitting portion 86 side is formed as a bearing contact surface 93 configured to be in contact with a drum contact surface 124 (described later).

The right flange member 81 is fitted onto a right end portion of the element tube 80 in such a way that the right element tube fitting portion 84 is inserted into a right side of the element tube 80 so as to be unable to rotate relative to the right side, and that a left end surface of the edge portion 85 comes in contact with a right end surface of the element tube 80 and faces the right end surface.

Figure 5A:
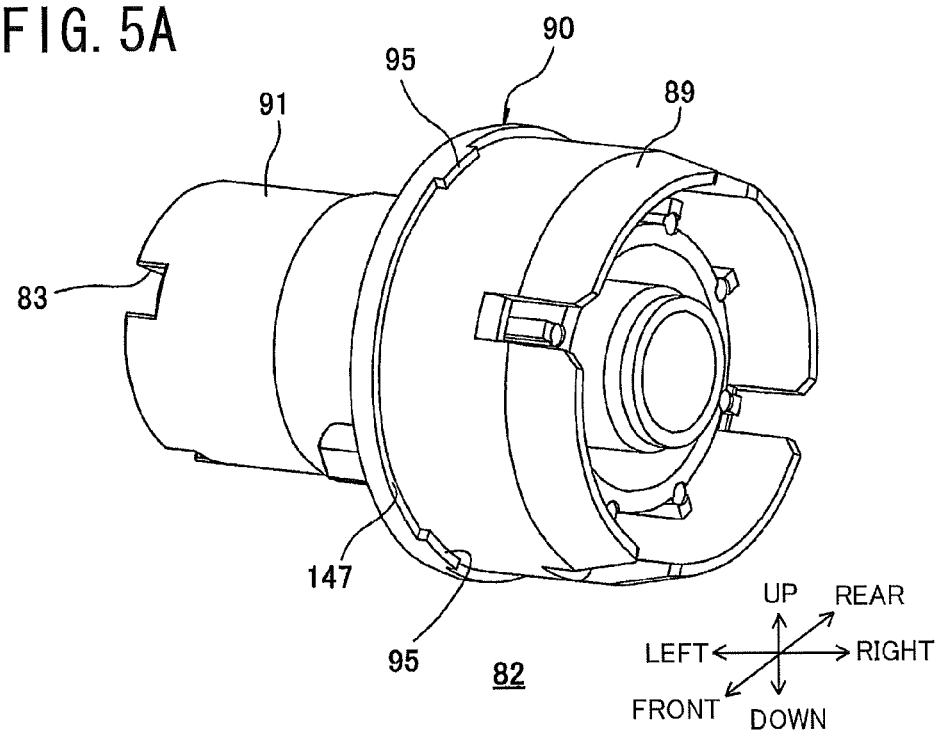
FIG. 5A is an exploded perspective view from a front right side of a flange member shown in FIG. 4A.

The left flange member 82 is made of resin. As shown in FIG. 5A, the left flange member 82 is provided integrally with a left element tube fitting portion 89, an edge portion 90, and a left bearing fitting portion 91. The left element tube fitting portion 89 is substantially formed in the shape of a cylinder that has a bottom with a left end surface thereof closed. The edge portion 90 is formed so as to protrude from an outer circumferential surface of a left end portion of the left element tube fitting portion 89 outwardly in a radial direction; a right end surface thereof is formed as a facing portion 147.

Figure 5B:
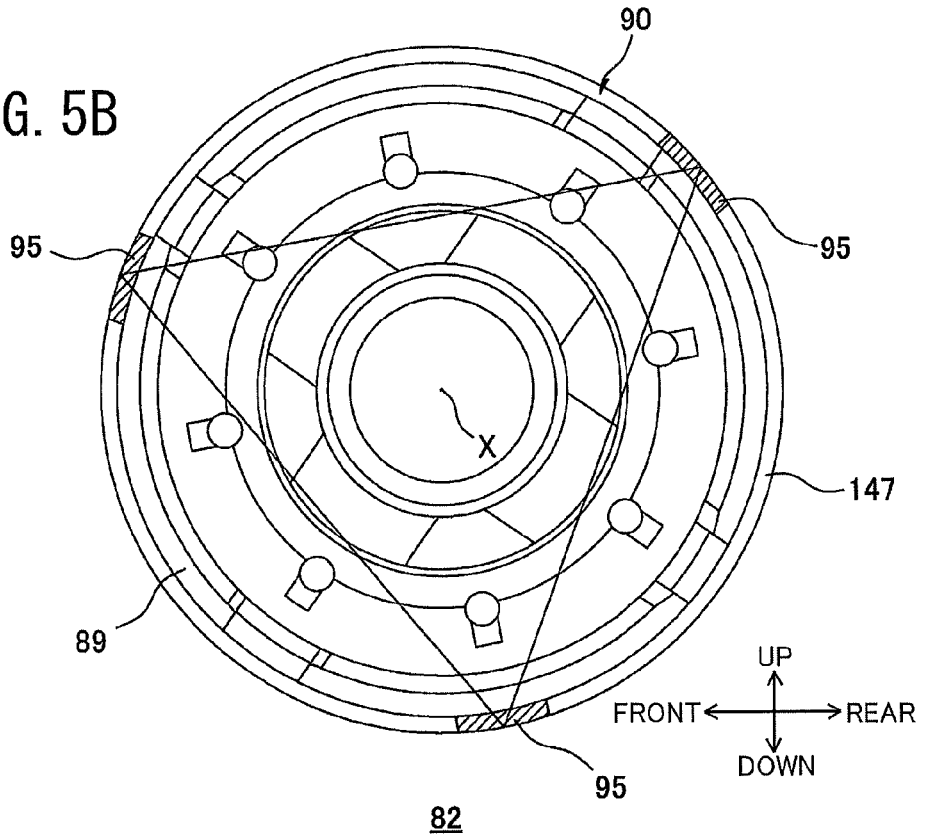
FIG. 5B is a right side view of the flange member shown in FIG. 5A.

A plurality of projecting portions 95 (three projecting portions in this embodiment) are formed on the facing portion 147. The projecting portions 95 are formed in a substantial rectangle shape when being viewed from the side so as to project from the facing portion 147 to the right side (See FIG. 5B). As shown in FIG. 5B, the plurality of projecting portions 95 are disposed so as to be equally spaced out in a circumferential direction and to be shifted from each other with an angle of about 120 degrees therebetween. When being projected in the left-right direction, the plurality of projecting portions 95 are disposed such that an axial line of the left element tube fitting portion 89 is positioned inside a triangle formed by the line segments connecting the circumferential-direction central portions of the three projecting portions 95.

The left bearing fitting portion 91 is formed substantially in a columnar shape and has a smaller diameter than the outer diameter of the left element tube fitting portion 89. The left bearing fitting portion 91 is formed so as to share a central axis line with the left element tube fitting portion 89 and to project from the left element tube fitting portion 89 to the left side with a convex cross-sectional surface.

The left bearing fitting portion 91 is capable of receiving driving force for rotating the photosensitive drum 15 when the left bearing fitting portion 91 is in a predetermined state (a driving-force receivable state).

As shown in FIG. 4A, four coupling fitting holes 83 are provided on a left end surface of the left bearing fitting portion 91. Drum-side body couplings 142 (See FIGS. 8A and 8B) provided in the main casing 2 are joined to respective coupling fitting holes 83.

The four coupling fitting holes 83 are formed substantially in a U-shape opening outwardly in a radial direction when being viewed from the side. The four coupling fitting holes 83 are positioned on a left end surface of the left bearing fitting portion 91 so as to be equally spaced apart in a circumferential direction and to be shifted from each other with an angle of about 90 degrees therebetween.

A photosensitive drum gear 87 is provided on the left bearing fitting portion 91 so as to be unable to rotate relative to the left bearing fitting portion 91. The photosensitive drum gear 87 is formed in the shape of an annular disc that extends from an outer circumferential surface of a right end portion of the left bearing fitting portion 91 outwardly in a radial direction. Engagement teeth 88 (FIG. 4A) are formed on a peripheral end surface of the photosensitive drum gear 87.

The left flange member 82 is fitted onto a left end portion of the element tube 80 in such a way that the left element tube fitting portion 89 is inserted into a left side of the element tube 80 so as to be unable to rotate relative to the left side, that the facing portion 147 is spaced apart from a left end surface of the element tube 80 and faces the left end surface of the element tube 80, and that each projecting portion 95 contacts with the left end surface of the element tube 80. The left element tube fitting portion 89 is fitted onto a left end portion of the element tube 80 in such a way that a central axis thereof is aligned with an axis X (See FIG. 5B) of the element tube 80.

Figures 8A, 8B, 8C:
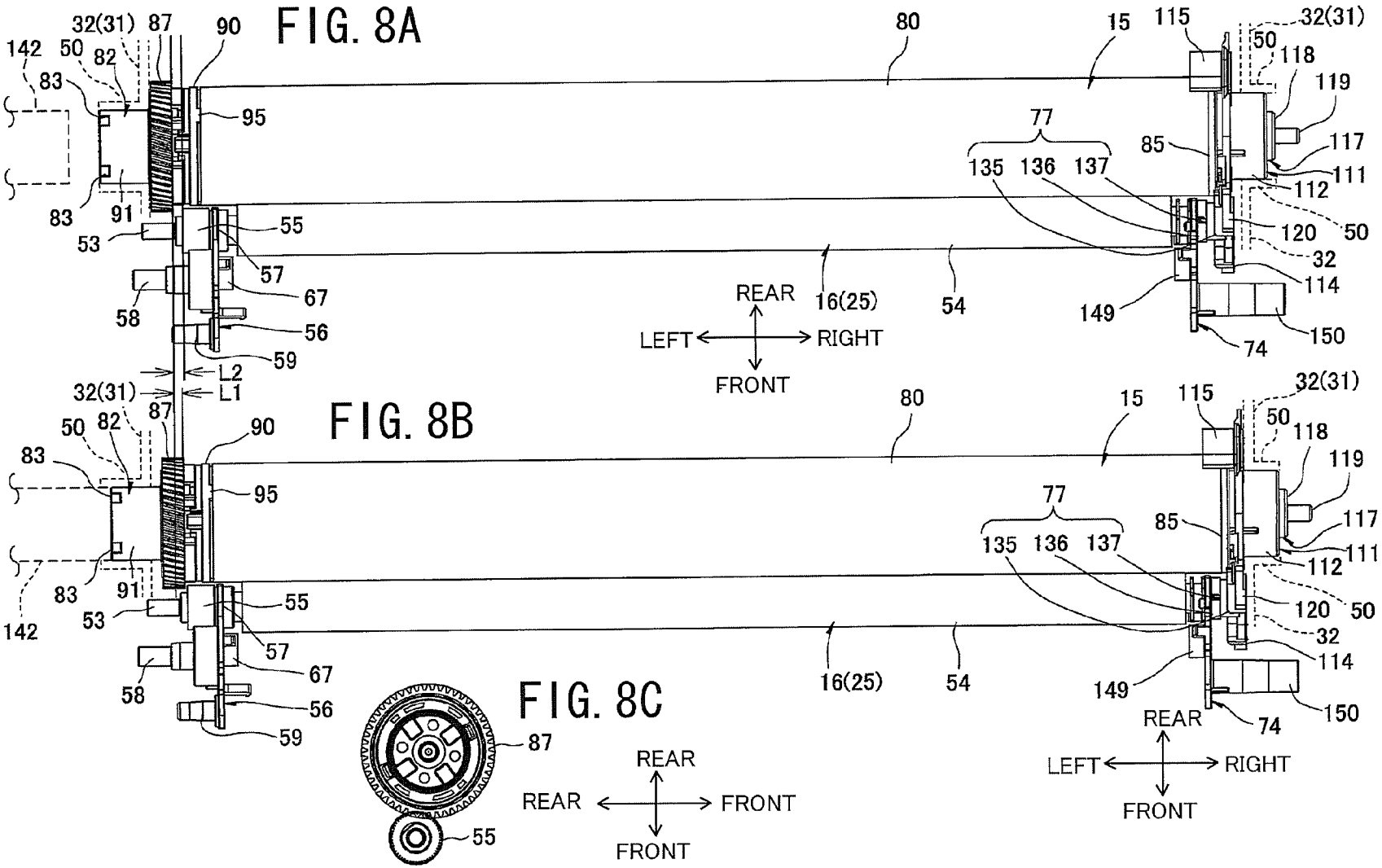
FIGS. 8A through 8C are explanatory diagrams showing a position relationship between the photosensitive drum and the developing roller.

As shown in FIGS. 8A and 8B, the distance from a right end portion of the edge portion 85 of the right flange member 81 to a left end portion of the edge portion 90 of the left flange member 82 is shorter than the distance between the left and right side walls 32. In FIGS. 8A and 8B, a left bearing member 126 (described later) is omitted.

As shown in FIG. 4A, the drum cleaning roller 29 includes a cleaning roller shaft 96 and a sponge roller 97. The sponge roller 97 covers the cleaning roller shaft 96.

A cleaning gear 98 is provided on an outer circumferential surface of the cleaning roller shaft 96. The cleaning gear 98 is provided so as to be unable to rotate relative to the left end portion of the cleaning roller shaft 96. Engagement teeth 99 are formed on a peripheral end surface of the cleaning gear 98.

The photosensitive drum 15 and the drum cleaning roller 29 are connected together via a connecting member 105 and a bearing member 110 so as to regulate the relative movement of the photosensitive drum 15 and the drum cleaning roller 29. The photosensitive drum gear 87 engages with the cleaning gear 98.

The connecting member 105 is formed substantially in the shape of a drop-shaped flat plate becoming narrower toward the rear side when being viewed from the side. In other words, the connecting member 105 becomes narrower toward the rear side. The connecting member 105 includes a cleaning shaft insertion portion 106 and a coupling member insertion hole 107.

The cleaning shaft insertion portion 106 is formed substantially in a cylindrical-shape on a rear end portion of the connecting member 105 and projects from a left surface of the connecting member 105 leftward. The cleaning shaft insertion portion 106 has an inner diameter substantially equal to a diameter of the cleaning roller shaft 96.

On the front side of the connecting member 105, the coupling member insertion hole 107 is formed substantially in the circular shape when being viewed from the side so as to pass through the connecting member 105 in the left-right direction. The coupling member insertion hole 107 has a diameter larger than an outer diameter of the left bearing fitting portion 91.

The bearing member 110 includes a right bearing member 111 (end member) and a left bearing member 126. The right bearing member 111 is provided integrally with the cylindrical portion 112, a flange portion 113, a lower guide portion 114, an upper guide portion 120, and a cleaning shaft support portion 115.

Figure 6:
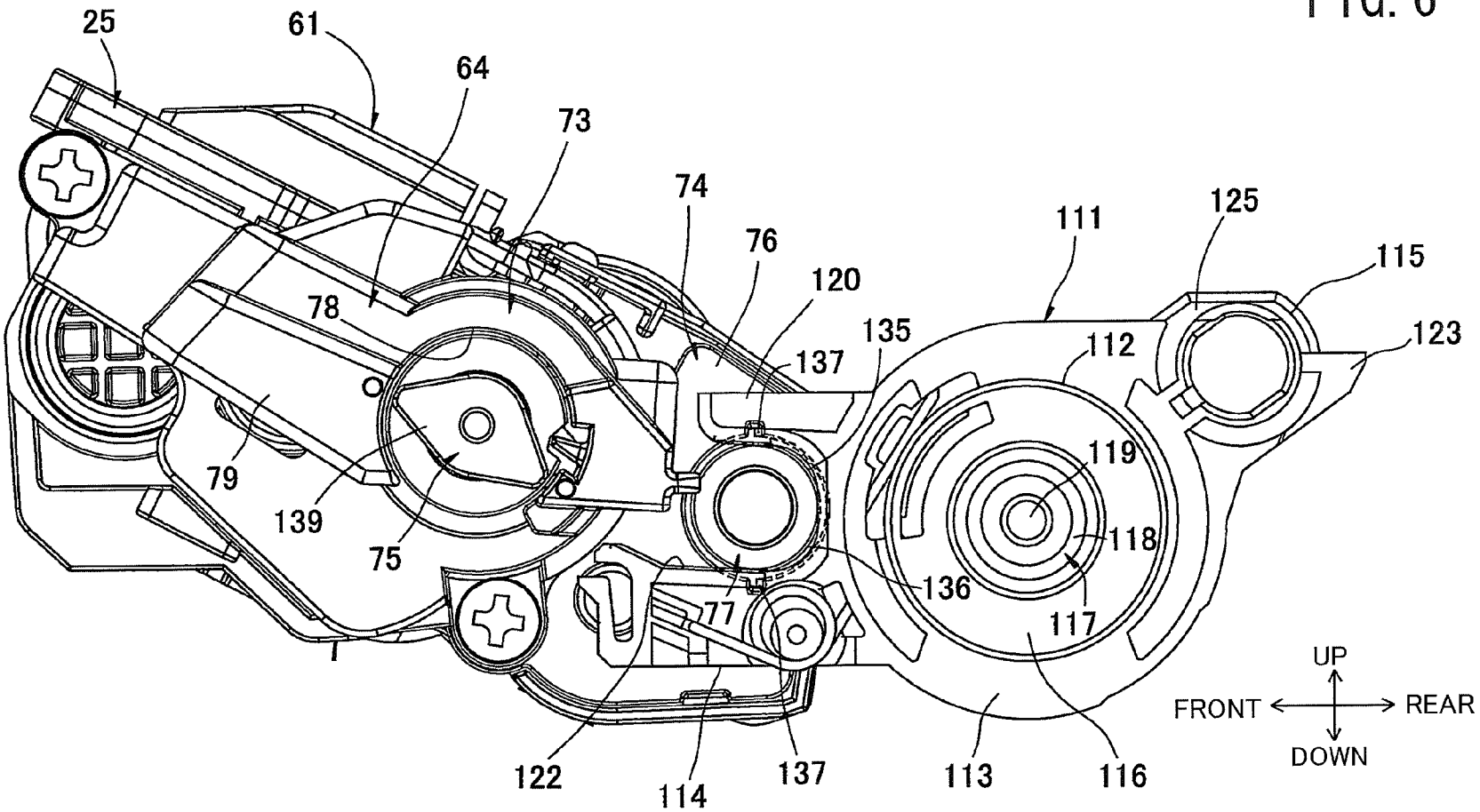
FIG. 6 is a right side view of a developing cartridge and a right bearing member when developing cartridge shown in FIG. 2 is mounted on the drum cartridge.

The cylindrical portion 112 is formed substantially in a cylindrical shape. The cylindrical portion 112 has an inner diameter substantially equal to or slightly larger than the outer diameter of the right bearing fitting portion 86. As shown in FIG. 6, the right end portion of the cylindrical portion 112 is closed by a closing wall 116.

As shown in FIGS. 4A and 4B, a shaft holding portion 117 is provided on the closing wall 116. The shaft holding portion 117 is formed substantially in the shape of a cylinder that passes through a central portion of the closing wall 116 in the left-right direction. The shaft holding portion 117 holds a shaft 119 so that both end portions of the shaft protrude from the shaft holding portion 117 in the left-right direction.

A right end surface of the shaft holding portion 117 is formed as a body contact surface 118. A left end surface of the shaft holding portion 117 is formed as the drum contact surface 124.

The flange portion 113 is formed substantially in the form of an annular disc that extends from a left-right-direction intermediate portion of an outer circumferential surface of the cylindrical portion 112 outwardly in a radial direction of the cylindrical portion 112.

The lower guide portion 114 is formed substantially in the shape of a flat plate that extends frontward from a front lower side portion of the flange portion 113. A left end surface of the lower guide portion 114 is formed as a developing frame contact surface 121. That is, the body contact surface 118 is provided farther from the right end portion of the photosensitive drum 15 than are the drum contact surface 124 and the developing frame contact surface 121.

The upper guide portion 120 is formed substantially in the shape of a flat plate that extends frontward from a front upper side portion of the flange portion 113. The upper guide portion 120 is spaced apart from the lower guide portion 114 in the up-down direction and faces the lower guide portion 114. The upper guide portion 120 has the front-rear-direction length shorter than the front-rear-direction length of the lower guide portion 114 (See FIG. 6), and has a thickness smaller than the thickness of the lower guide portion 114 (See FIG. 7).

The upper surface of the lower guide portion 114, the lower surface of the upper guide portion 120 and the corresponding flange portion 113 define a guide groove 122. The guide groove 122 is substantially formed in a U-shape opening upward when being viewed from the side.

The cleaning shaft support portion 115 includes an extension portion 123 and a tube portion 125. The extension portion 123 is formed substantially in the shape of a flat plate that is substantially in a triangle shape when being viewed from the side. The extension portion 123 extends rearward seamlessly from a rear upper side portion of the flange portion 113. The tube portion 125 is formed substantially in a cylindrical shape and passes through the extension portion 123 in the left-right direction.

The left bearing member 126 is provided integrally with the cylindrical portion 127, a flange portion 128, a lower guide portion 129, an upper guide portion 130, a cleaning bearing portion 131, and a flat plate portion 132.

The cylindrical portion 127 is formed substantially in a cylindrical shape. The cylindrical portion 127 has an inner diameter substantially equal to or slightly larger than an outer diameter of the left bearing fitting portion 91. The cylindrical portion 127 has an outer diameter substantially equal to the outer diameter of the cylindrical portion 112 of the right bearing member 111.

The flange portion 128 is formed substantially in the shape of an annular disc that extends from a left-right-direction intermediate portion of an outer circumferential surface of the cylindrical portion 127 outwardly in a radial direction of the cylindrical portion 127.

The lower guide portion 129 is formed substantially in the shape of a flat plate that extends frontward from a front lower side portion of the flange portion 128.

The upper guide portion 130 is formed substantially in the shape of a flat plate that extends frontward from a front upper side portion of the flange portion 128. The upper guide portion 130 is positioned apart from the lower guide portion 129 in the up-down direction and faces the lower guide portion 129.

An upper surface of the lower guide portion 129, a lower surface of the upper guide portion 130, and the flange portion 128 define a guide groove 133. The guide groove 133 is substantially in a U-shape opening upward when being viewed from the side.

The cleaning bearing portion 131 is formed substantially in the shape of a flat plate that extends from a rear upper side portion of the flange portion 128 to the rear upper side. On the cleaning bearing portion 131, a cleaning bearing hole 134 is formed. The cleaning bearing hole 134 is formed substantially in a circular shape when being viewed from the side and passes through a central portion of the cleaning bearing portion 131 in the left-right direction. The inner diameter of the cleaning bearing hole 134 is substantially equal to the outer diameter of the cleaning shaft insertion portion 106. The flat plate portion 132 is formed substantially in the shape of a flat plate that extends upward from an upper side portion of the flange portion 128.

The right bearing member 111 is provided on a right end portion of the photosensitive drum 15 such that the cylindrical portion 112 is fitted onto the right bearing fitting portion 86 of the right flange member 81 (or fitted onto a radial-direction outside of the right bearing fitting portion 86), and that the shaft 119 is inserted into the shaft insertion hole 102.

The left bearing member 126 is provided on a left end portion of the photosensitive drum 15 in such a way that the cylindrical portion 127 is fitted onto the left bearing fitting portion 91 of the left flange member 82 (or fitted onto a radial-direction outside of the left bearing fitting portion 91).

The photosensitive drum 15 is rotatably supported by the drum frame 31 as the cylindrical portion 112 fitted onto the right bearing fitting portion 86 and the cylindrical portion 127 fitted onto the left bearing fitting portion 91 are each supported by the drum bearing portions 50 (FIG. 3).

That is, the cylindrical portion 112 of the right bearing member 111 and the cylindrical portion 127 of the left bearing member 126 hold the right bearing fitting portion 86 and the left bearing fitting portion 91 in a way that enables the right bearing fitting portion 86 and the left bearing fitting portion 91 to rotate.

As shown in FIGS. 8A and 8B, the length of the photosensitive drum 15 between a right end portion of the edge portion 85 of the right flange member 81 and a left end portion of the edge portion 90 of the left flange member 82 is shorter than the distance between the two side walls 32. Therefore, the photosensitive drum 15 is supported by the two side walls 32 in such a way that there is some play in the left-right direction. That is, the photosensitive drum 15 is supported so as to be able to move with a predetermined range of distance L1 in the left-right direction relative to the two side walls 32. The distance L1 that the photosensitive drum 15 can move is set shorter than a distance (interval) L2 (described later) between the photosensitive drum gear 87 and a developing gear 55 (described later) in the left-right direction.

As shown in FIG. 3, the coupling fitting holes 83 of the left bearing fitting portion 91 are exposed through the left drum bearing portion 50. As shown in FIGS. 8A, 8B, and 11, a right end portion of the shaft holding portion 117 of the right bearing member 111 projects from the right drum bearing portion 50. That is, the body contact surface 118 is positioned closer to the right side than the right drum bearing portion 50.

(2) Developing Cartridge

Figure 2:
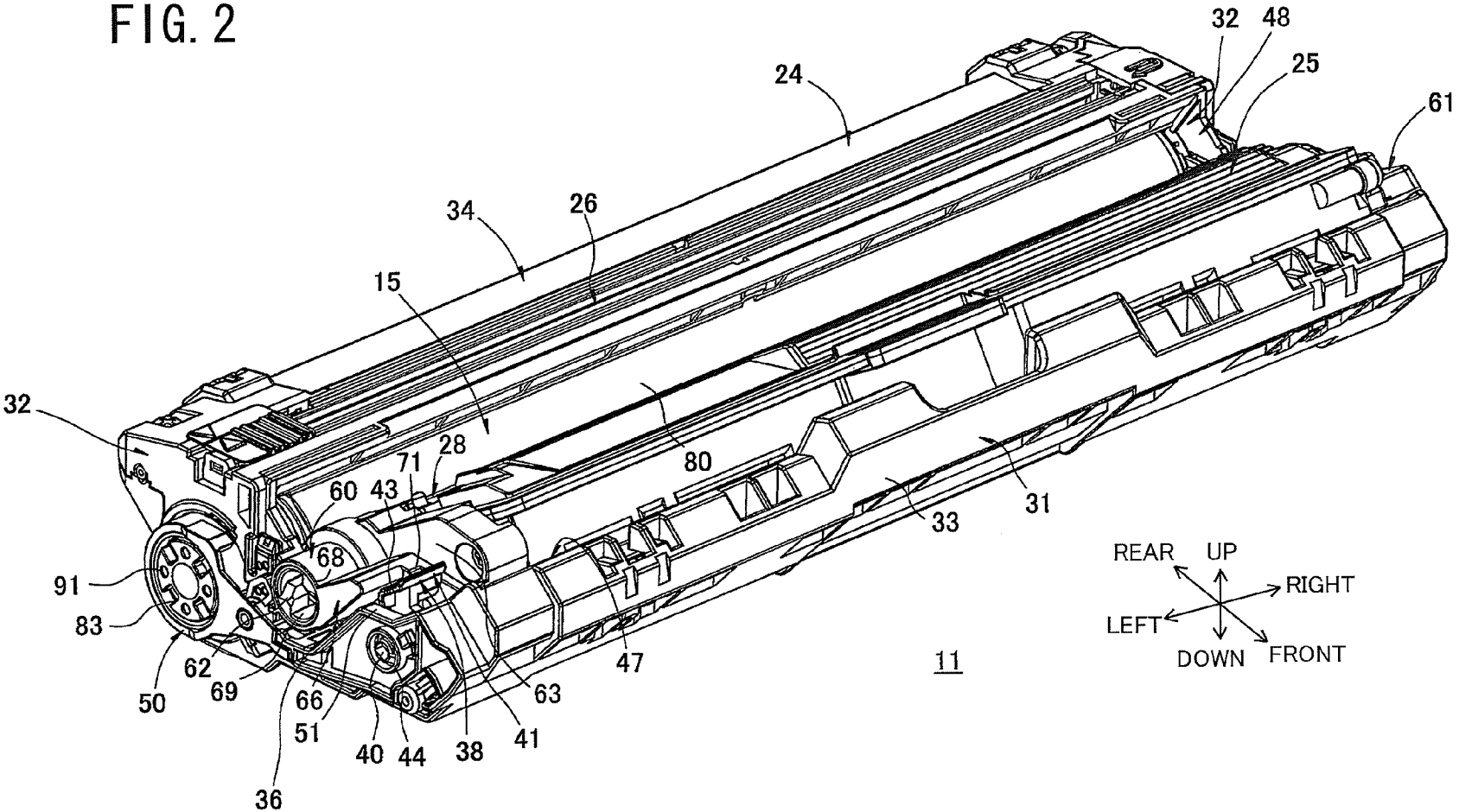
FIG. 2 is a perspective view from an upper left side of the process cartridge shown in FIG. 1.

As shown in FIG. 2, the developing cartridge 25 includes a developing frame 61 and the developing roller 16. The developing frame 61 is formed substantially in a box-shape extending in the left-right direction. The developing roller 16 is accommodated in a rear end portion of the developing frame 61 (See FIG. 1).

As shown in FIGS. 8A and 8B, the developing roller 16 includes a developing roller shaft 53 and a rubber roller 54 for covering the developing roller shaft 53

The developing gear 55 is provided on an outer circumferential surface of the left end portion of the developing roller shaft 53 so as to be unable to rotate relative to the left end portion of the developing roller shaft 53. The developing roller 16 is rotatably supported by the developing frame 61 (FIG. 2) as left and right end portions of the developing roller shaft pivotably pass through left and right side walls of the developing frame 61, respectively.

Figure 7:
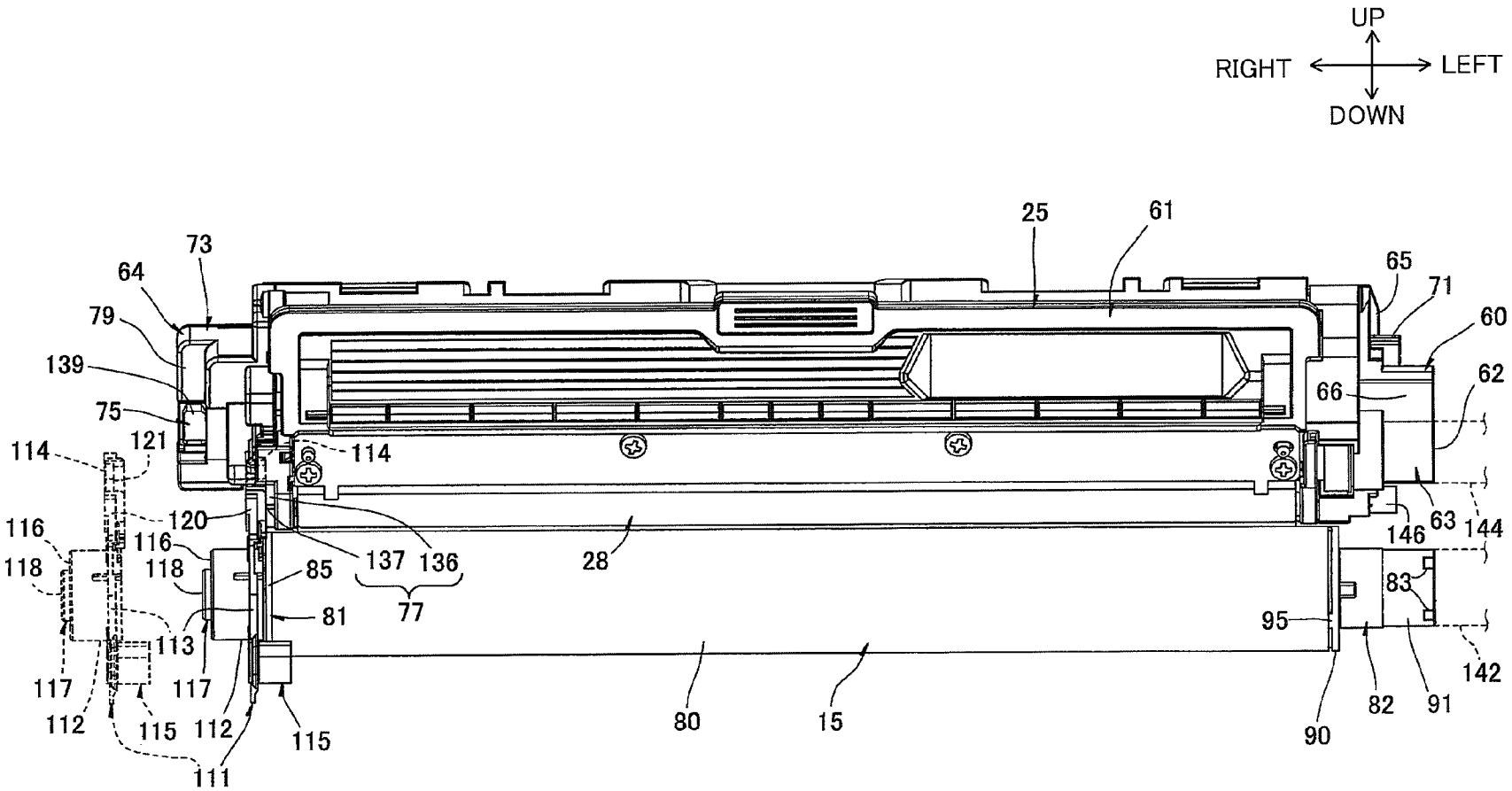
FIG. 7 is a front view of the developing cartridge, the photosensitive drum, and the right bearing member when the process cartridge shown in FIG. 2 is mounted on a main casing.

As shown in FIG. 7, a driving unit 60 is provided on a left side wall of the developing frame 61, and a power supply unit 73 on a right side wall of the developing frame 61. The driving unit 60 is provided with a developing side bearing member 56 (See FIGS. 8A and 8B), the development coupling 62, and a driving side gear cover 63.

As shown in FIGS. 8A and 8B, the developing side bearing member 56 is formed substantially in the shape of a rectangular flat plate when being viewed from the side. The developing side bearing member 56 includes a developing roller shaft support hole 57, a supply roller shaft support portion 67, a coupling support shaft 58, and an idle gear support shaft 59.

In an upper side rear end portion of the developing side bearing member 56, the developing roller shaft support hole 57 is formed substantially in the circular shape when being viewed from the side and pass the developing side bearing member 56 in the left-right direction. The inner diameter of the developing roller shaft support hole 57 is substantially equal to or slightly larger than the shaft diameter of the developing roller shaft 53.

On the front lower side of the developing roller shaft support hole 57, the supply roller shaft support portion 67 is formed substantially in the shape of a cylinder that projects from a right surface of the developing side bearing member 56 to the right side.

On the front side of the developing roller shaft support hole 57, the coupling support shaft 58 is formed substantially in the shape of a column that projects from a left surface of the developing side bearing member 56 to the left side.

In the front end portion of the developing side bearing member 56, the idle gear support shaft 59 is formed substantially in the shape of column that projects leftward from a left surface of the developing side bearing member 56. The idle gear support shaft 59 supports an idle gear (not shown) rotatably. The idle gear is disposed in the driving side gear cover 63 (FIG. 2) and has a gear train (described later) which is not shown in the diagram.

The developing side bearing member 56 is fitted onto a left side of a left side wall of the developing frame 61 in such a way that a left end portion (specifically, a portion positioned closer to the right side than the developing gear 55 is) of the developing roller shaft 53 is inserted into the developing roller shaft support hole 57, and that a left end portion of a rotation shaft (not shown) of the supply roller 27 is inserted into the supply roller shaft support portion 67.

As shown in FIG. 2, the development coupling 62 is formed substantially in the shape of a column that extends in the left-right direction. A coupling concave portion 69 is formed on a left end surface of the development coupling 62. The development coupling 62 is accommodated in the driving side gear cover 63 so as to be able to rotate, with the coupling concave portion 69 exposed through a coupling exposure opening 68 (described later). The development coupling 62 is capable of receiving driving force for rotating the developing roller 16 when the developing coupling is in a predetermined state (driving-force-receivable state).

The development coupling 62 is supported by the left side wall of the developing frame 61, as the coupling support shaft 58 (FIGS. 8A and 8B) of the developing side bearing member 56 is inserted into an internal space thereof from the left side.

The driving side gear cover 63 extends in the left-right direction and is formed substantially in the shape of a tube with a left end portion thereof closed.

Figure 9:
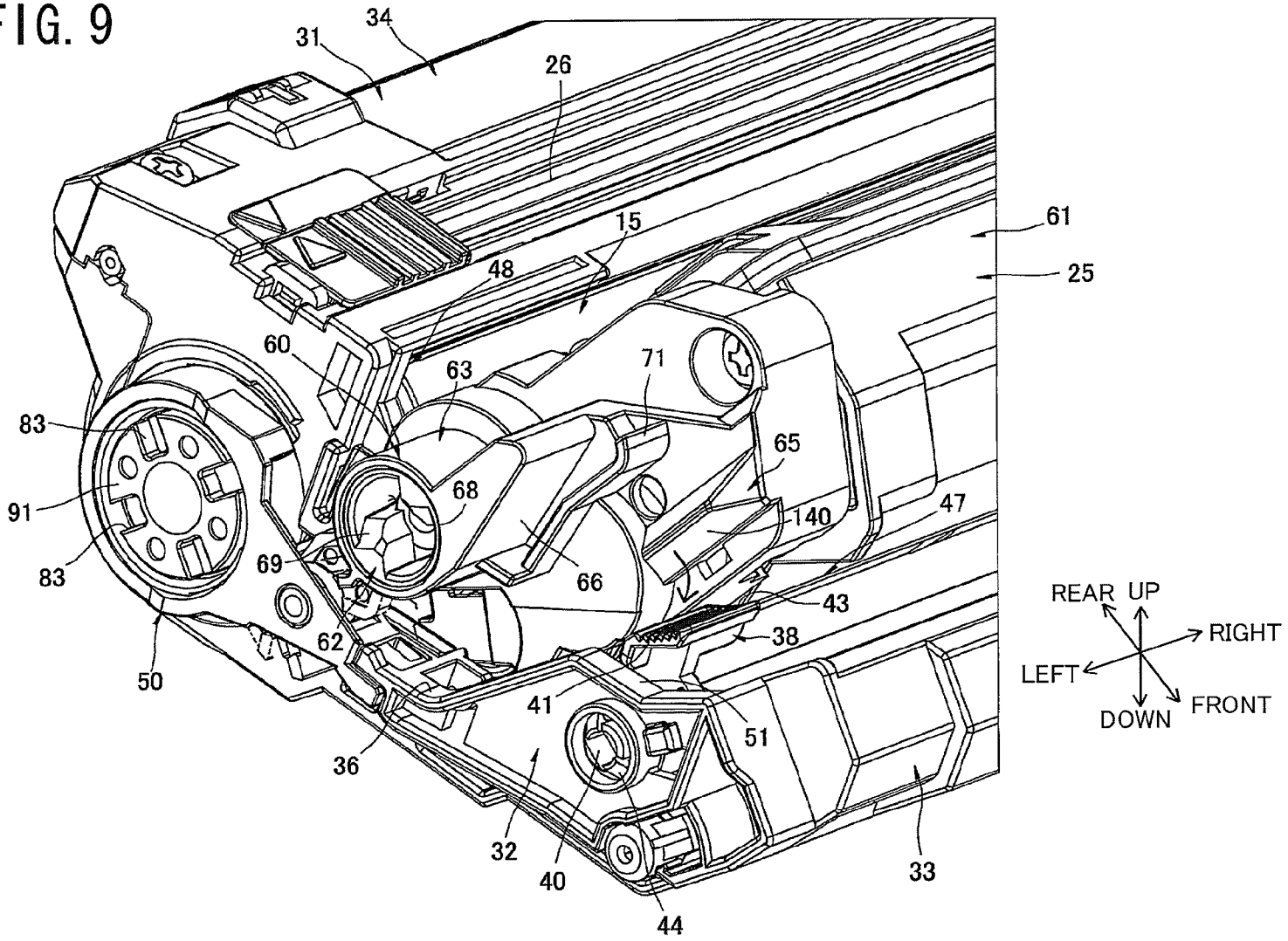
FIG. 9 is a perspective view from a front left side of the developing cartridge and the drum cartridge shown in FIG. 2 when the developing cartridge is being mounted to the drum cartridge.

As shown in FIG. 9, the coupling exposure opening 68, a pressed portion 66, a regulating portion 71, and a contact portion 65 are provided on a left wall of the driving side gear cover 63.

At a center portion of the driving side gear cover 63 in the front-rear-direction, the coupling exposure opening 68 is so formed as to pass through the driving side gear cover 63 and to be substantially in a circular shape when being viewed from the side, allowing a left surface of the development coupling 62 to be exposed.

On a front side of the coupling exposure opening 68, the pressed portion 66 is formed substantially in the shape of a flat plate that projects from a left surface of the driving side gear cover 63 to the left side.

The regulating portion 71 is provided on a lower side of the pressed portion 66, and is formed so as to substantially in the shape of a flat plate that projects from the left surface of the driving side gear cover 63 to the left side, and to extend substantially parallel to a lower surface of the pressed portion 66.

On a front lower side of the regulating portion 71, the contact portion 65 is formed substantially in the shape of a wedge that bulges leftward from the left surface of the driving side gear cover 63. More specifically, a cross-sectional surface of the contact portion 65 is so formed as to be triangular. A lower surface of the contact portion 65 is formed as an inclined plane 140. The inclined plane 140 inclines upwardly toward the left side.

The driving side gear cover 63 is so provided as to cover at least part of left side wall of the developing frame 61.

As shown in FIG. 6, the power supply unit 73 includes an electrode member 74, a new product detection gear 75, and a power supply side gear cover 64.

The electrode member 74 is made of a conductive resin material (e.g. POM (polyacetal) resin), and, as shown in FIGS. 8A and 8B, is formed substantially in the shape of a rectangular flat plate when being viewed from the side (See FIG. 6).

The electrode member 74 is provided integrally with a developing roller shaft collar 77, a supply roller shaft support portion 149, and an electricity receiving portion 150.

The developing roller shaft collar 77 is formed substantially in the shape of a cylinder (See FIG. 6), and is so formed as to project from a right surface of the electrode member 74 to the right side.

As shown in FIGS. 6, 8A, and 8B, a left side portion (base end portion's side) of the developing roller shaft collar 77 is formed as a large-diameter portion 136, and a right side portion thereof as a small-diameter portion 135.

As shown in FIG. 6, the large-diameter portion 136 is formed substantially in a cylinder shape, and two projecting portions 137 are provided in a base end portion thereof. The projecting portion 137 is formed substantially in the shape of a rectangle when being viewed from the side so as to protrude from an outer circumferential surface of the large-diameter portion 136 outwardly in a radial direction. Both projecting portions 137 are so provided as to face each other in the radial direction.

The small-diameter portion 135 is formed substantially in the cylindrical shape and has a smaller diameter than the large-diameter portion 136. The small-diameter portion 135 is formed so as to share a central axis line with the large-diameter portion 136 and to project from the large-diameter portion 136 to the right side with a convex cross-sectional surface.

As shown in FIGS. 8A and 8B, the supply roller shaft support portion 149 is disposed on the front lower side of the developing roller shaft collar 77. The supply roller shaft support portion 149 is formed substantially in the shape of a cylinder that extends leftward from a left surface of the electrode member 74.

The electricity receiving portion 150 is disposed in the front end portion of the electrode member 74. The electricity receiving portion 150 is formed substantially in the shape of a cylinder that extends rightward from a right surface of the electrode member 74. The electrode member 74 is fitted onto a right side of a right side wall of the developing frame 61 in such a way that a right end portion of the developing roller shaft 53 is inserted into the developing roller shaft collar 77, and that a right end portion of a rotation shaft (not shown) of the supply roller 27 is inserted into the supply roller shaft support portion 149. Incidentally, the left end portion of the developing roller shaft 53 is inserted into a collar member 146 having a substantial cylindrical shape (See FIG. 7).

As shown in FIGS. 6 and 7, the new product detection gear 75 is formed substantially in the shape of a column that extends in the left-right direction. The new product detection gear 75 includes a detected end portion 139 in a right end portion thereof. The new product detection gear 75 is accommodated in the power supply side gear cover 64 so as to be able to rotate and to allow the detected end portion 139 to be exposed through a detected end portion exposure opening 78 (described later).

The new product detection gear 75 is supported by the right side wall of the developing frame 61, as the electricity receiving portion 150 of the electrode member 74 is inserted into an internal space of the new product detection gear 75 from the right side.

Incidentally, when the developing cartridge 25 is mounted in the main casing 2 and the detected end portion 139 of the new product detection gear 75 contacts to a body-side electrode (not shown) provided in the main casing 2, the developing cartridge 25 is detected as a new product.

The power supply side gear cover 64 extends in the left-right direction, and is formed substantially in the shape of a tube with a right end portion thereof closed. As shown in FIG. 6, the detected end portion exposure opening 78 and a bulging portion 79 are provided on a right wall of the power supply side gear cover 64.

At a center portion of the power supply side gear cover 64 in the front-rear-direction, the detected end portion exposure opening 78 is so formed as to pass through the power supply side gear cover 64 and to be substantially in a circular shape when being viewed from the side, allowing a right end portion of the new product detection gear 75 to be exposed.

On the front side of the detected end portion exposure opening 78, the bulging portion 79 is formed substantially in the shape of a rectangle when being viewed from the side so as to protrude rightward from the right surface of the power supply side gear cover 64. The power supply side gear cover 64 is configured to cover at least part of the right side wall of the developing frame 61.

Figure 11:
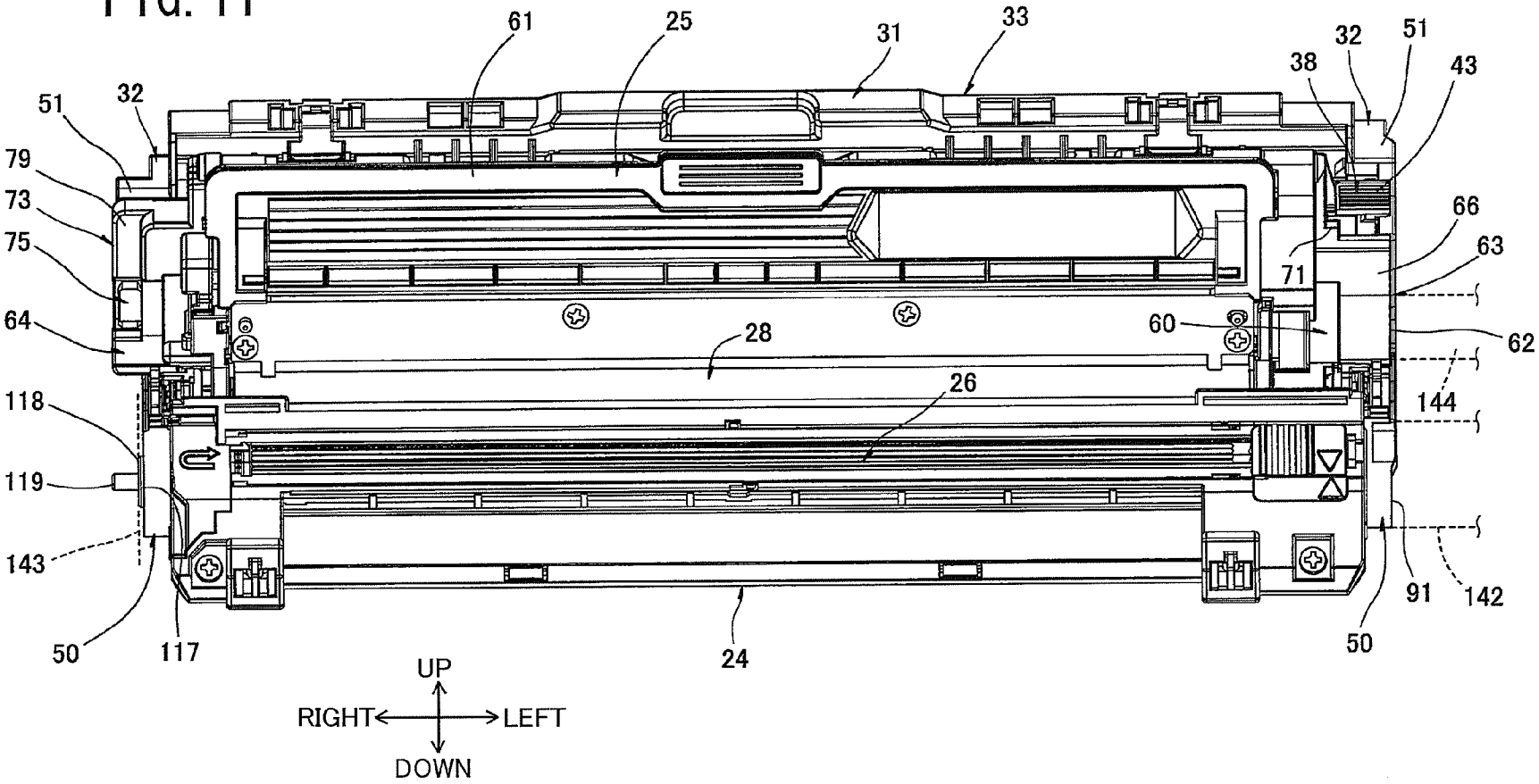
FIG. 11 is a front view of the process cartridge when the process cartridge is mounted into the main casing.

As shown in FIGS. 2 and 11, the maximum length in the left-right direction of the developing cartridge 25 is substantially equal to the maximum length in the left-right direction of the drum cartridge 24. More specifically, the left-right-direction length between a left end portion of the pressed portion 66 and a right end portion of the bulging portion 79 is substantially equal to the left-right-direction length between left-right-direction outer side end portions of the flange portions 51 of the two side walls 32.

3. Mounting of Process Cartridge to Main Casing

The following describes how the process cartridge 11 is mounted on the main casing 2.

(1) Mounting of Developing Cartridge to Drum Cartridge

Before the process cartridge 11 is mounted on the main casing 2, the developing cartridge 25 is mounted on the drum cartridge 24. Incidentally, at the time of referring to directions when the way the developing cartridge 25 is mounted on the drum cartridge 24 is explained, with respect to the situation where the process cartridge 11 is placed on a horizontal surface in such a way that the lower wall 35 of the drum cartridge 24 faces the lower side, a side on which the developing roller 16 is supported is referred to as a rear side of the developing cartridge 25, and a side on which the layer thickness regulating blade 28 is supported is referred to as an upper side.

In order to mount the developing cartridge 25 onto the drum cartridge 24, as shown in FIGS. 2 and 9, the developing cartridge 25 is placed above the developing cartridge mounting portion 47 in such a way that the pressed portion 66 of the driving side gear cover 63 and the bulging portion 79 (See FIG. 6) of the power supply side gear cover 64 are disposed above the respective flange portions 51.

Then, the rear end portion of the developing cartridge 25 is inserted into the rear end portion of the developing cartridge mounting portion 47 in such a way that the small-diameter portion 135 (FIG. 6) of the developing roller shaft collar 77 is inserted into the guide groove 122 of the right bearing member 111 and that the collar member 146 (See FIG. 7) of the developing roller shaft 53 into the guide groove 133 (FIG. 4A) of the left bearing member 126. As a result, the small-diameter portion 135 is supported by the guide groove 122, and the collar member 146 by the guide groove 133.

Figure 10A:
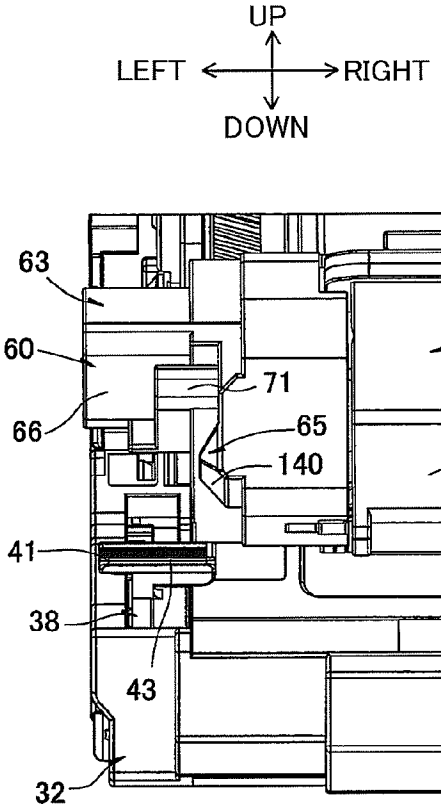
FIG. 10A is an enlarged view of a left end portion of the developing cartridge before developing cartridge is guided by a locking lever shown in FIG. 2.
Figure 10B:
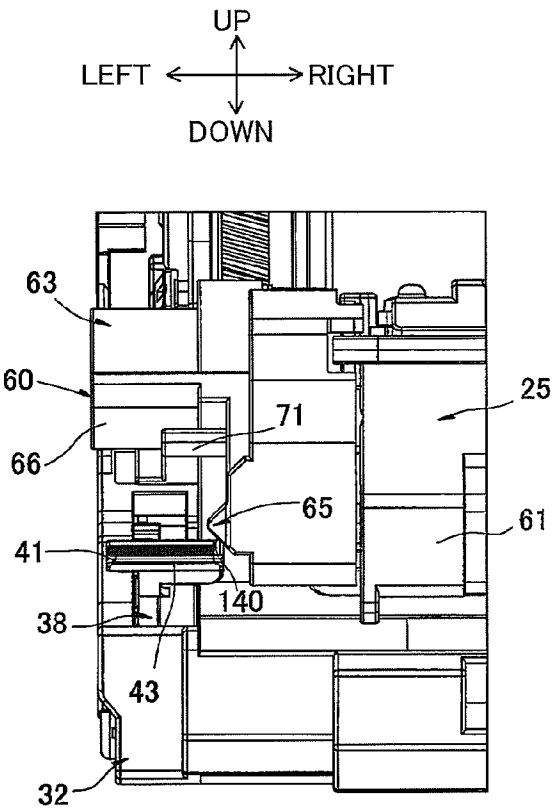
FIG. 10B is an enlarged view of the left end portion of the developing cartridge when developing cartridge is being guided by the locking lever.

Then, as shown in FIGS. 9 and 10A, the front end portion of the developing cartridge 25 is pushed into the front end portion of the developing cartridge mounting portion 47 in such a way that the front end portion of the developing cartridge 25 pivots about the rear end portion of the developing cartridge 25 functioning as a fulcrum in a clockwise direction when being viewed from the left side. Then, as shown in FIG. 10B, the inclined plane 140 of the contact portion 65 of the developing cartridge 25 comes in contact with a right end portion of the guide portion 43 of the locking lever 38 from the upper side.

As the front end portion of the developing cartridge 25 is further pushed into the front end portion of the developing cartridge mounting portion 47, the developing cartridge 25 is guided along the inclined plane 140 and moves rightward while being pushed into the front end portion of the developing cartridge mounting portion 47.

Figure 10C:
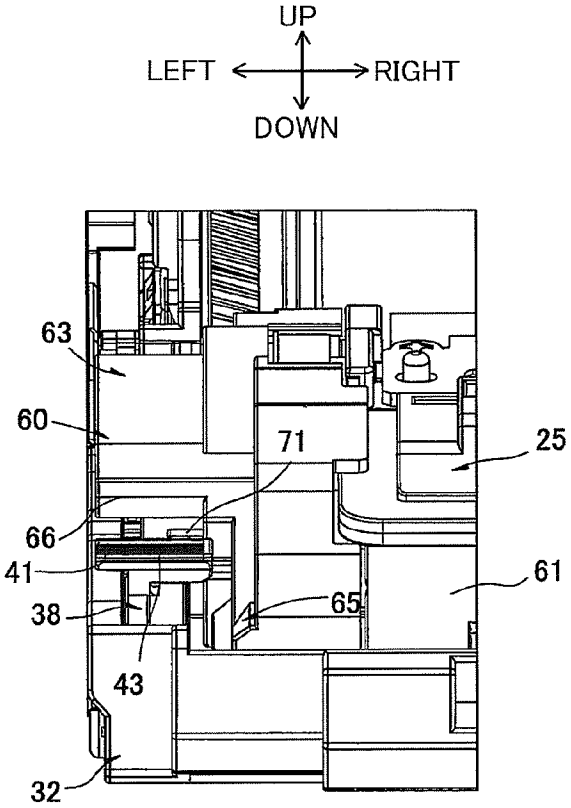
FIG. 10C is an enlarged view of the left end portion of the developing cartridge after developing cartridge has been guided by the locking lever.

At this time, as shown in FIGS. 2 and 10C, the developing cartridge 25 moves rightward and frontward. A right side portion of the rear end portion of the guide portion 43 comes in contact with a front end portion of the regulating portion 71. As a result, the movement of the developing cartridge 25 in the front-rear direction relative to the drum frame 31 is regulated.

Incidentally, the developing cartridge 25 is mounted on the drum frame 31 in such a way there is some play (allowance, clearance) in the left-right direction. Therefore, the developing cartridge 25 can move in the left-right direction.

Consequently, the developing cartridge 25 is accommodated in the developing cartridge mounting portion 47. In this manner, an operation of mounting the developing cartridge 25 onto the drum cartridge 24 is completed.

At this time, as shown in FIGS. 8A and 8B, the element tube 80 of the photosensitive drum 15 is in contact with the rubber roller 54 of the developing roller 16. Moreover, the developing gear 55 is disposed at a front right side of the photosensitive drum gear 87. In other words, the developing gear 55 is disposed at an inward position in the left-right direction relative to a position in which the drum gear 87 is disposed in the left-right direction. As shown in FIG. 8A, when the photosensitive drum 15 and the developing cartridge 25 are positioned at the leftmost relative to the drum frame 31, the left end portion of the developing gear 55 and the right end portion of the photosensitive drum gear 87 are disposed so that there is a distance L2 therebetween in the left-right direction.

When being projected in the left-right direction, the photosensitive drum gear 87 and the developing gear 55 are so disposed that a front end portion of the photosensitive drum gear 87 overlaps with a rear end portion of the developing gear 55 as shown in FIG. 8C. In other words, the photosensitive drum gear 87 and the developing gear 55 are partially overlapped when being projected in the left-right direction.

Incidentally, as shown in FIG. 10C, when the developing cartridge 25 is completely mounted in the developing cartridge mounting portion 47, the contact portion 65 passes along the right end portion of the guide portion 43 in the up-down direction, and the contact portion 65 departs from the guide portion 43.

In order to remove the developing cartridge 25 from the drum cartridge 24, first the guide portion 43 of the locking lever 38 is pushed so that the locking lever 38 pivots in a clockwise direction when being viewed from the left side against the pushing force of a pushing member (not shown). As a result, the locking lever 38 is placed at an unlocking position (not shown).

Then, a lift portion (not shown) of the locking lever 38 pushes the pressed portion 66 of the developing cartridge 25 from the lower side upwardly. As a result, the front end portion of the developing cartridge 25 is lifted upwardly from the developing cartridge mounting portion 47 of the drum cartridge 24.

Then, the front end portion of the developing cartridge 25 is held by a user and the developing cartridge 25 is removed upwardly from the developing cartridge mounting portion 47 of the drum cartridge 24. In this manner, an operation of removing the developing cartridge 25 from the drum cartridge 24 is completed.

(2) Mounting of Process Cartridge onto Main Casing

The following describes how the process cartridge 11 is mounted on the main casing 2.

Referring to FIG. 1, in order to mount the process cartridge 11 on the main casing 2, the top cover 6 is opened and the process cartridge 11 is inserted into a predetermined space in the main casing 2 from the upper side.

Accordingly, the process cartridge 11 is mounted on the main casing 2 in such a way that a rear side thereof (i.e. the rear side that is so called when the way the developing cartridge 25 is mounted on the drum cartridge 24 is described) comes to a rear lower side of the printer 1, and that a front side thereof (i.e. the front side that is so called when the way the developing cartridge 25 is mounted on the drum cartridge 24 is described) comes to a front upper side of the printer 1.

(3) Inputting of Driving Force to Photosensitive Drum and Developing Roller

As shown in FIG. 7, the main casing 2 is provided with the drum side body coupling 142 and a development side body coupling 144. The drum side body coupling 142 faces the left flange member 82 of the photosensitive drum 15 in the left-right direction at a time when the process cartridge 11 is mounted on the main casing 2, and the development side body coupling 144 faces the development coupling 62 of the developing cartridge 25 in the left-right direction.

After the process cartridge 11 is mounted on the main casing 2, the drum side body coupling 142 moves rightward and pushes the left flange member 32 rightward before being connected to the coupling fitting holes 83 so that the drum side body coupling 142 is unable to rotate relative to the coupling fitting holes 83. As a result, a driving force from the drum side body coupling 142 is transmitted to the photosensitive drum 15, thereby driving and rotating the photosensitive drum 15.

Moreover, the photosensitive drum 15 moves rightward as the photosensitive drum 15 receives a pushing force from the drum side body coupling 142 via the left flange member 82 (in the driving-force receivable state). As a result, as shown in FIG. 4B, the bearing contact surface 93 of the right flange member 81 comes in contact with the drum contact surface 124 of the right bearing member 111.

After the process cartridge 11 is mounted on the main casing 2, the development side body coupling 144 moves rightward and pushes the development coupling 62 rightward before being connected to the coupling concave portion 69 of the development coupling 62 so as not to be able to rotate relative to the coupling concave portion 69. As a result, a driving force is transmitted from the development side body coupling 144 to the development coupling 62. The driving force is then transmitted to the developing gear 55 via the gear train disposed in the driving side gear cover 63, which is not shown in the diagrams. As a result, the developing roller 16 rotates as the developing roller 16 is driven.

The developing frame 61 moves to the right side as the developing frame 61 receives a pushing force from the development side body coupling 144 via the development coupling 62. As a result, as shown in FIG. 7, a lower side portion of the large-diameter portion 136 of the developing roller shaft collar 77 and a lower-side projecting portion 137 come in contact with the developing frame contact surface 121 of the right bearing member 111 (See FIG. 6).

As a result, the photosensitive drum 15 and the developing roller 16 each come in contact with the right bearing member 111, and the photosensitive drum 15 and the developing roller 16 are positioned relative to each other.

As shown in FIG. 11, the main casing 2 is provided with a positioning surface 143. The positioning surface 143 faces the body contact surface 118 of the right bearing member 111 in the left-right direction when the process cartridge 11 is mounted on the main casing 2.

After the drum side body coupling 142 is connected to the left flange member 82 and the development side body coupling 144 to the development coupling 62, the bearing contact surface 93 contacts to the drum contact surface 124 of the right bearing member 111 because of the pushing forces from the drum side body coupling 142 and the development side body coupling 144. Moreover, as the lower side portion of the large-diameter portion 136 of the developing roller shaft collar 77 and the lower-side projecting portion 137 come in contact with the developing frame contact surface 121 of the right bearing member 111, the process cartridge 11 moves rightward.

Then, the body contact surface 118 of the right bearing member 111 comes in contact with the positioning surface 143. As a result, the photosensitive drum 15 and the developing roller 16 are positioned relative to the main casing 2.

4. Operations and Effects (1) The process cartridge 11 includes the right bearing member 111.

As shown in FIG. 4, the right bearing member 111 includes the developing frame contact surface 121, the drum contact surface 124, and the body contact surface 118.

In the situation where a driving force can be input into the left bearing fitting portion 91 of the left flange member 82, in other words, in the situation where the left bearing fitting portion 91 and the drum side body coupling 142 are connected together (See FIG. 7), the bearing contact surface 93 of the right flange member 81 contacts with the drum contact surface 124.

As shown in FIGS. 6 and 7, in the situation where a driving force can be input into the development coupling 62, in other words, in the situation where the development coupling 62 and the development side body coupling 144 are connected together (See FIG. 7)), the lower side portion of the large-diameter portion 136 of the electrode member 74 and the lower-side projecting portion 137 contacts to the developing frame contact surface 121.

As a result, the photosensitive drum 15 and the developing frame 61 come in contact with a common member, that is, the right bearing member 111. Therefore, the accuracy of positioning the element tube 80 of the photosensitive drum 15 and the rubber roller 54 of the developing roller 16 relative to each other can be improved.

In the printer 1, as shown in FIG. 11, in the situation where a driving force can be input into the left flange member 82 and the development coupling 62, the process cartridge 11 as a whole is moved to the right side (that is, to the side opposite to the side where the driving force is input), and the body contact surface 118 comes in contact with the positioning surface 143 provided on the main casing 2.

Therefore, the photosensitive drum 15 and the developing roller 16 are positioned on the main casing 2 through the right bearing member 111. That is, according to the printer 1, an improvement can be made in the accuracy of positioning the photosensitive drum 15 and the developing roller 16 relative to the main casing 2.

Furthermore, the right flange member 81 and the right end portion of the developing frame 61 (the lower side portion of the large-diameter portion 136 and the lower-side projecting portion 137) come in contact with the right bearing member 111, which is a common member. Therefore, the photosensitive drum 15 and the developing roller 16 can be positioned close to each other (See FIGS. 8A and 8B). Therefore, the process cartridge 11 can be made smaller in size.

In that manner, as for the process cartridge 11, an improvement can be made in the accuracy of positioning the photosensitive drum 15 and the developing roller 16 relative to each other. At the same time, the process cartridge 11 can be made smaller in size.

(2) The right bearing member 111 is provided integrally with the cylindrical portion 112, the flange portion 113, the lower guide portion 114, and the upper guide portion 120. By the upper surface of the lower guide portion 114, the lower surface of the upper guide portion 120, and the flange portion 113, the guide groove 122 is partitioned off and defined.

When the developing cartridge 25 is mounted on the drum cartridge 24, the cylindrical portion 112 of the right bearing member 111 holds the right bearing fitting portion 86 in a way that allows the right bearing fitting portion 86 to rotate, and the guide groove 122 supports the small-diameter portion 135 of the developing roller shaft collar 77.

Since the right bearing member 111 supports both the photosensitive drum 15 and the developing roller 16, an improvement can be made in the accuracy of positioning the photosensitive drum 15 and the developing roller 16 relative to each other.

(3) As shown in FIGS. 8A and 8B, the left flange member 82 of the photosensitive drum 15 is provided with the photosensitive drum gear 87, and the left end portion of the developing roller shaft 53 of the developing roller 16 is provided with the developing gear 55.

When the developing cartridge 25 is mounted on the drum cartridge 24, the developing gear 55 is disposed at the front right side of the photosensitive drum gear 87. When being projected in the left-right direction, the rear end portion thereof is so disposed as to overlap with the front end portion of the photosensitive drum gear 87.

Therefore, even such a simple configuration is able to prevent unwanted toner from adhering. At the same time, the photosensitive drum 15 and the developing roller 16 can be positioned close to each other. As a result, the process cartridge 11 can be made smaller in size.

(4) The photosensitive drum 15 is supported by the two side walls 32 in such a way that the photosensitive drum 15 can move in the left-right direction. The distance L1 that the photosensitive drum 15 can move is shorter than the distance L2 in the left-right direction between the developing gear 55 and the photosensitive drum gear 87 at a time when the photosensitive drum 15 and the developing cartridge 25 have been brought to the leftmost side relative to the drum frame 31. Therefore, even if the photosensitive drum 15 moves in the left-right direction, the contact of the photosensitive drum gear 87 with the developing gear 55 can be avoided.

(5) The locking lever 38 is provided on the left side wall 32 of the drum frame 31 as shown in FIG. 10. The locking lever 38 is provided with the operation portion 41. The guide portion 43 is provided in the upper end portion of the operation portion 41.

As the developing cartridge 25 is mounted on the drum cartridge 24, the inclined plane 140 of the contact portion 65 of the driving side gear cover 63 comes in contact with the right end portion of the guide portion 43 of the locking lever 38, enabling the developing cartridge 25 to be guided to the right side.

Therefore, when the developing cartridge 25 is mounted on the drum cartridge 24, the developing frame 61 and the right bearing member 111 are positioned close to each other.

That is, in the situation where a driving force can be input into the development coupling 62, the developing frame 61 and the right bearing member 111 can be positioned close to each other, ensuring that the lower side portion of the large-diameter portion 136 and the lower-side projecting portion 137 come in contact with the developing frame contact surface 121.

(6) As shown in FIG. 11, the left-right-direction length between the left end portion of the pressed portion 66 of the driving side gear cover 63 and the right end portion of the bulging portion 79 of the power supply side gear cover 64 is substantially equal to the left-right-direction length between the left-right-direction outer side end portions of the flange portions 51 of the two side walls 32.

Therefore, when the developing cartridge 25 is mounted on the drum cartridge 24, the developing cartridge 25 can be inserted into the drum cartridge 24 such that the left end portion of the pressed portion 66 is aligned with the left end portion of the left flange portion 51, and the right end portion of the bulging portion 79 with the right end portion of the right flange portion 51.

As a result, the visibility of the drum cartridge 24 can be improved even at a time when the developing cartridge 25 is inserted. Therefore, the developing cartridge 25 can be smoothly mounted on the drum cartridge 24.

(7) As shown in FIG. 7, the developing frame 61 includes the driving side gear cover 63 on the left side wall thereof, and the power supply side gear cover 64 on the right side wall thereof. Therefore, damage to the developing frame 61 (developing cartridge 25) can be prevented.

(8) As shown in FIG. 4A, the photosensitive drum 15 includes the element tube 80 and the left flange member 82. As shown in FIG. 5A, the left flange member 82 is provided integrally with the left element tube fitting portion 89, the edge portion 90, and the left bearing fitting portion 91.

The edge portion 90 has the right end surface that is positioned apart from the left end surface of the element tube 80 and faces the left end surface. The right end surface is formed as the facing portion 147. The plurality of projecting portions 95 are formed on the facing portion 147.

The plurality of projecting portions 95 are in contact with the left end surface of the element tube 80 (See FIGS. 8A and 8B), enabling the positional relationship between the element tube 80 and the left flange member 82 to be kept constant. As a result, an improvement can be made in the accuracy of positioning the photosensitive drum 15 relative to the drum frame 31.

Furthermore, as shown in FIG. 5B, the three projecting portions 95 are disposed on the facing portion 147 so as to be equally spaced apart from each other in the circumferential direction and to be shifted from each other with an angle of about 120 degrees therebetween. Therefore, when the left flange member 82 is pushed, the element tube 80 of the photosensitive drum 15 can be pushed by the drum side body coupling 142 to the right side in such a way that the force is evenly applied thereto. As a result, a further improvement can be made in the accuracy of positioning the element tube 80 of the photosensitive drum 15 and the rubber roller 54 of the developing roller 16 relative to each other.

5. Modifications

While the invention has been described in detail with reference to the embodiment thereof, it would be apparent to those skilled in the art that various changes and modifications may be made therein without departing from the spirit of the invention.

In the above-described left flange member 82, three projecting portions 95 are provided on the facing portion 147 as shown in FIG. 5B. However, the number of projecting portions 95 is not specifically limited. For example, two projecting portions 95 may be provided as shown in FIG. 12A, or six projecting portions 95 may be provided as shown in FIG. 12B.

Figure 12A:
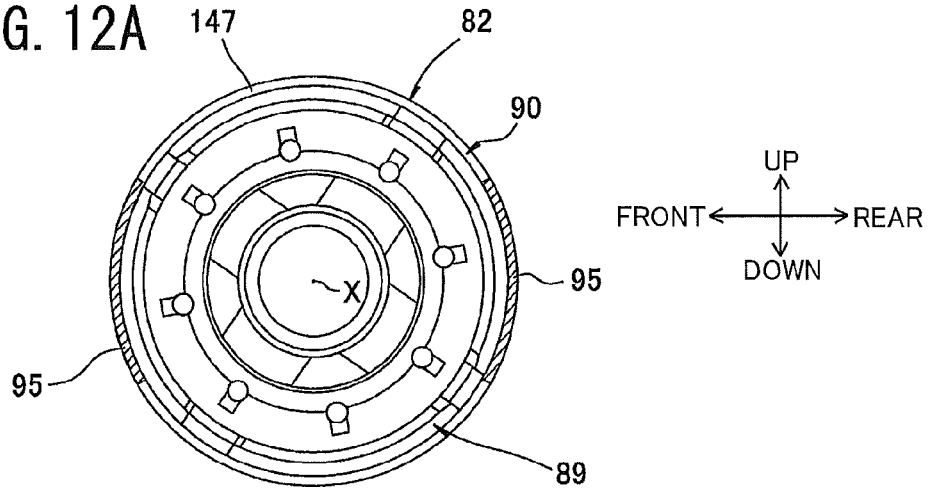
FIG. 12A is a right side view of a flange member according to a first modification of the embodiment.

If two projecting portions 95 are provided on the facing portion 147 as shown in FIG. 12A, the two projecting portions 95 are so provided as to face each other in a radial direction, and the circumferential-direction length thereof is longer than that of the projecting portions 95 of the above-described embodiment.

Figure 12B:
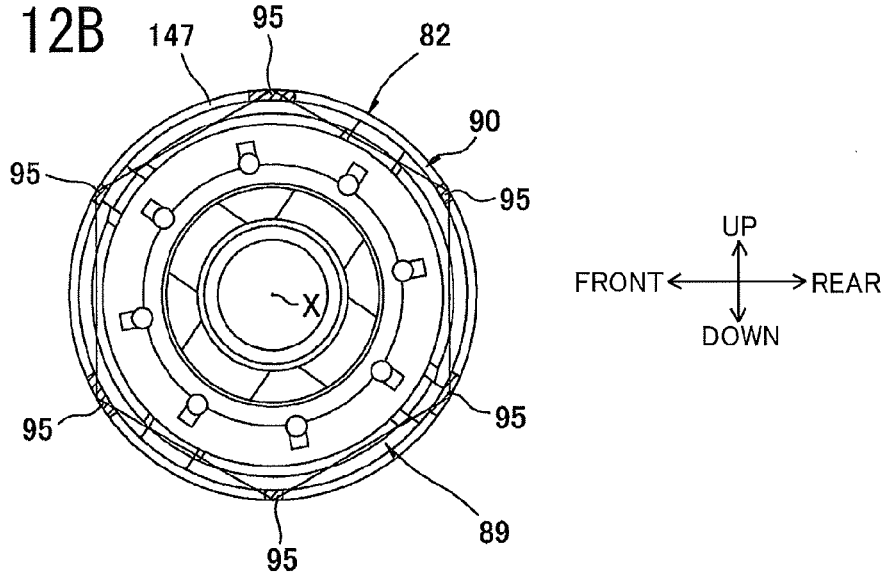
FIG. 12B is a right side view of a flange member according to a second modification of the embodiment.

If six projecting portions 95 are provided on the facing portion 147 as shown in FIG. 12B, the six projecting portions 95 are so formed as to be equally spaced out in a circumferential direction and to be shifted from each other with an angle of about 60 degrees therebetween. The circumferential-direction length of the projecting portions 95 may be made shorter than that of the projecting portions 95 of the above-described embodiment.

In the above modified example, when being projected in the left-right direction, the six projecting portions 95 are disposed in such a way that the axis line X of the element tube 80 (the left element tube fitting portion 89) is positioned inside a hexagon formed by line segments connecting the circumferential-direction central portions of the adjacent projecting portions 95.

As shown in FIG. 5B, three projecting portions 95 are disposed on the above-described left flange member 82 so as to be equally spaced apart from each other in the circumferential direction and to be shifted from each other with an angle of about 120 degrees therebetween. However, the projecting portions 95 may not be equally spaced away as shown in FIG. 12C.

Figure 12C:
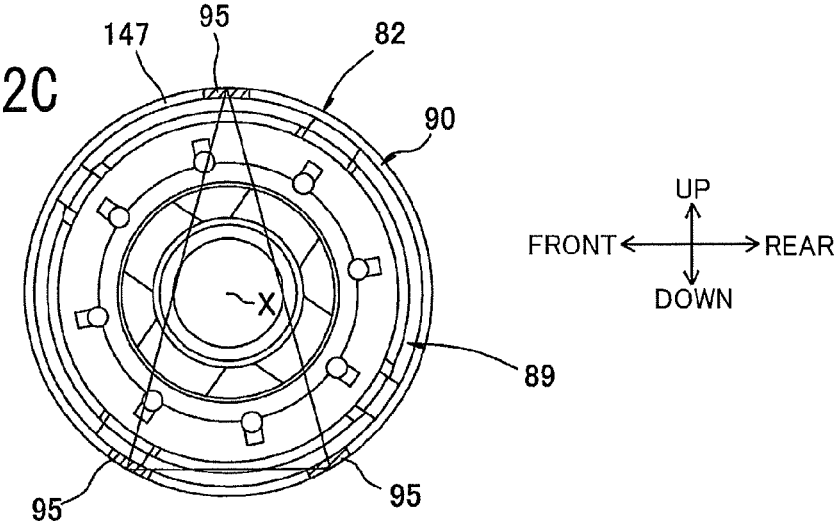
FIG. 12C is a right side view of a flange member according to a third modification of the embodiment.

Incidentally, even in the modified example shown in FIG. 12C, when being projected in the left-right direction, the projecting portions 95 are disposed in such a way that the axis line X of the element tube 80 (left element tube fitting portion 89) is positioned inside a triangle formed by line segments connecting the circumferential-direction central portions of the projecting portions 95.

That is, on the left flange member 82 provided with the plurality of projecting portions 95, a polygon that is formed by virtual line segments connecting the circumferential-direction central portions of the adjacent projecting portions 95 is not specifically limited as long as the axis line X of the element tube 80 (left element tube fitting portion 89) is positioned inside the polygon.

What is claimed is:

1. A process cartridge comprising:

a developing cartridge including:

a developer carrying member defining an axis extending in a first axis direction and configured to rotate around the axis;

a developing frame configured to accommodate the developer carrying member therein and having a first side portion and a second side portion that is opposite to the first side portion in the first axis direction; and a first receiving unit disposed on the first side portion and capable of receiving a first driving force for rotating the developer carrying member when the first receiving unit is in a predetermined state; and a drum cartridge including:

a drum frame to which the developing frame is mounted such that the developing frame is movable within a prescribed range of distance in the first axis direction relative to the drum frame;

a photosensitive drum extending in a second axis direction parallel to the first axis direction and configured to rotate relative to the drum frame, the photosensitive drum is movable in the second axis direction relative to the drum frame within a predetermined range of distance, the photosensitive drum having a first end portion and a second end portion opposite to the first end portion in the second axis direction, the first end portion being closer to the first side portion than to the second side portion, the second end portion being closer to the second side portion than to the first side portion; and a second receiving unit disposed on the first end portion and capable of receiving a second driving force for rotating the photosensitive drum when the second receiving unit is in a predetermined state; and an end member including:

a drum contact surface to which the second end portion of the photosensitive drum contacts when both the first receiving unit and the second receiving unit are in the predetermined state;

a developing frame contact surface to which the second side portion of the developing frame contacts when both the first receiving unit and the second receiving unit are in the predetermined state;

a drum supporting portion configured to rotatably support the photosensitive drum;

a developer-carrying-member supporting portion configured to support the developer carrying member when the developing frame is mounted on the drum frame; and an external member contact surface configured to contact with an external member when both the first receiving unit and the second receiving unit are in the predetermined state, the external member contact surface being disposed farther from the second end portion of the photosensitive drum in the second axis direction than the developing frame contact surface is;

wherein the end member is provided integrally with the drum contact surface, the developing frame contact surface, and the external member contact surface.

2. The process cartridge according to claim 1, wherein the drum cartridge further includes a drum gear disposed on the first end portion of the photosensitive drum;

wherein the developing cartridge further includes a developing gear disposed on the first side portion of the developer carrying member;

wherein the drum gear and the developing gear are partially overlapped when being projected in a direction parallel to the first axis direction.

3. The process cartridge according to claim 2, wherein the developing gear is disposed at an inward position in the first axis direction relative to a position in which the drum gear is disposed in the second axis direction.

4. The process cartridge according to claim 3, wherein the predetermined range of distance is smaller than an interval between the drum gear and the developing gear in a direction parallel to the first axis direction.

5. The process cartridge according to claim 1, wherein the drum frame includes a guiding portion that is disposed closer to the first end portion of the photosensitive drum than to the second end portion of the photosensitive drum in a direction parallel to the first axis direction and configured to guide the developing cartridge such that the developing cartridge moves away from the first side portion of the drum frame when the developing cartridge is mounted on the drum cartridge.

6. The process cartridge according to claim 5, wherein the first side portion is provided with a contact portion, the contact portion having an inclined surface configured to contact to the guiding portion when the developing cartridge is mounted on the drum cartridge.

7. The process cartridge according to claim 5, wherein a maximum length of the developing cartridge in the first axis direction is substantially equal to a maximum length of the drum cartridge in the second axis direction.

8. The process cartridge according to claim 1, wherein the developing cartridge further includes:

a first covering member configured to cover at least part of the first side portion; and a second covering member configured to cover at least part of the second side portion.

9. The process cartridge according to claim 1, wherein the photosensitive drum includes:

an element tube extending in the second axis direction and having a first end part in the second axis direction, the first end part having a first end; and a flange member that is fitted on the first end part and has the second receiving unit and an edge portion confronting to the first end, the edge portion including:

a facing portion configured to face to and be spaced apart from the first end; and a plurality of projecting portions projecting from the facing portion toward the element tube in the second axis direction and configured to contact with the first end.

10. The process cartridge according to claim 9, wherein the flange member includes at least three projecting portions as the plurality of projecting portions.

11. The process cartridge according to claim 10, wherein an axis of the element tube is positioned inside a polygon defined by connecting virtual lines, each virtual line being defined by connecting two projecting portions of the plurality of projecting portions that are adjacent to each other.

12. A process cartridge comprising:

a developing unit including:

a developer carrying member defining an axis extending in a first axis direction and configured to rotate around the axis, the developing carrying member having a first side portion and a second side portion that is opposite to the first side portion in the first axis direction;

a developing gear disposed on the first side portion of the developer carrying member; and a first transmitting unit configured to transmit a first driving force to the developer carrying member via the developing gear; and a photosensitive unit including:

a photosensitive drum extending in a second axis direction parallel to the first axis direction, the photosensitive drum having a first end portion and a second end portion opposite to the first end portion in the second axis direction, the first end portion being closer to the first side portion than to the second side portion, the second end portion being closer to the second side portion than to the first side portion;

a drum frame having a pair of side walls arranged in the second axis direction and spaced apart from each other;

a drum gear disposed on the first end portion of the photosensitive drum; and a second transmitting unit configured to transmit a second driving force to the photosensitive drum; and wherein the drum gear and the developing gear are partially overlapped when being projected in a direction parallel to the first axis direction;

wherein the drum gear is disposed at an inward position in the second axis direction relative to a position in which the drum frame is disposed in the second axis direction; and wherein the developing gear is disposed at an inward position in the first axis direction relative to the position in which the drum frame is disposed in the second axis direction.

13. The process cartridge according to claim 12, wherein the developing gear is disposed at an inward position in the first axis direction relative to a position in which the drum gear is disposed in the second axis direction.

14. The process cartridge according to claim 13, wherein the photosensitive drum is movable within a predetermined range of distance in the second axis direction, wherein the predetermined range is smaller than an interval between the drum gear and the developing gear in a direction parallel to the first axis direction.

* * * * *